US005653395A

United States Patent [19]

Iwade et al.

[11] Patent Number: 5,653,395

[45] Date of Patent: Aug. 5, 1997

[54] YARN WINDING METHOD AND APPARATUS AND PACKAGE FORMED THEREBY

[75] Inventors: Takashi Iwade, Souraku-gun; Yoshiro Migaki; Jun Takagi, both of Otsu, all of Japan

[73] Assignee: Toray Engineering Co., Ltd., Japan

[21] Appl. No.: 367,187

[22] PCT Filed: May 13, 1994

[86] PCT No.: PCT/JP94/00700

§ 371 Date: Jan. 12, 1995

§ 102(e) Date: Jan. 12, 1995

[87] PCT Pub. No.: WO94/26645

PCT Pub. Date: Nov. 24, 1994

[30] Foreign Application Priority Data

May 13, 1993 [JP] Japan ..... 5-136572
Dec. 28, 1993 [JP] Japan ..... 5-74483 U

[51] Int. Cl.[6] ..... B65H 67/044; B65H 75/10

[52] U.S. Cl. ..... 242/18 A; 242/18 PW; 242/118.32

[58] Field of Search ..... 242/18 A, 18 PW, 242/130, 610, 118.32

[56] References Cited

U.S. PATENT DOCUMENTS

| | | | |
|---|---|---|---|
| 2,006,797 | 7/1935 | Dunlap | 242/118.32 |
| 2,381,869 | 8/1945 | Amrhein et al. | 242/118.32 |
| 3,451,639 | 6/1969 | Atwood et al. | 242/118.32 |
| 3,488,010 | 1/1970 | Parry | 242/18 PW |
| 3,628,747 | 12/1971 | Bakewell | 242/118.32 |
| 3,794,260 | 2/1974 | Sowell | 242/18 PW X |
| 3,880,371 | 4/1975 | Landenberger et al. | 242/35 SR |
| 4,018,401 | 4/1977 | Cunningham | 242/18 PW X |
| 4,081,149 | 3/1978 | Miller | 242/18 PW |
| 4,103,834 | 8/1978 | Banning | 242/18 PW |
| 4,477,032 | 10/1984 | Pfyffer et al. | 242/18 PW |
| 4,561,600 | 12/1985 | Greive et al. | 242/18 PW X |
| 4,646,981 | 3/1987 | Ohayon | 242/18 PW |
| 4,792,104 | 12/1988 | Tate | 242/18 PW |
| 5,029,762 | 7/1991 | Behrens et al. | 242/18 PW X |
| 5,170,961 | 12/1992 | Bolz et al. | 242/18 PW X |
| 5,248,103 | 9/1993 | Polnik | 242/18 PW |

FOREIGN PATENT DOCUMENTS

| | | |
|---|---|---|
| 958394 | 11/1974 | Canada . |
| 2 246 721 | 4/1974 | Germany . |
| 48-19573 | 6/1973 | Japan . |
| 48-36693 | 11/1973 | Japan . |
| 51-43411 | 4/1976 | Japan . |
| 57-36233 | 8/1982 | Japan . |
| 62-280172 | 12/1987 | Japan . |
| 63-192368 | 12/1988 | Japan . |
| 1-156168 | 10/1989 | Japan . |
| 1-164266 | 11/1989 | Japan . |
| 3-177275 | 8/1991 | Japan . |
| 1175965 | 1/1970 | United Kingdom . |
| 2 015 046 | 9/1979 | United Kingdom . |

*Primary Examiner*—Michael Mansen

[57] ABSTRACT

To reliably carry out the yarn-catching operation and formation of bunch-winding and tail-winding, while using a bobbin having no yarn-catching groove thereon, and obtain a package with a shorter yarn end extended from the bunch-winding part, upstream of a pressure roller 7, a yarn-holding guide 24 is provided for guiding a running yarn to a bunch-winding position; downstream of an empty bobbin 70, a yarn-searching guide 29 is provided for guiding the yarn to the yarn-catching part or a threading guide 33 and a yarn-winding guide 37 movable toward a concave space (A) formed by the pressure roller 7 and the empty bobbin 70 carried on a spindle 4 to guide the yarn 80 running to a full bobbin 70' or others to a yarn-catching part B formed between the abutting end walls of adjacent empty bobbins 70 carried on the spindle 4.

5 Claims, 35 Drawing Sheets

FIG. 13
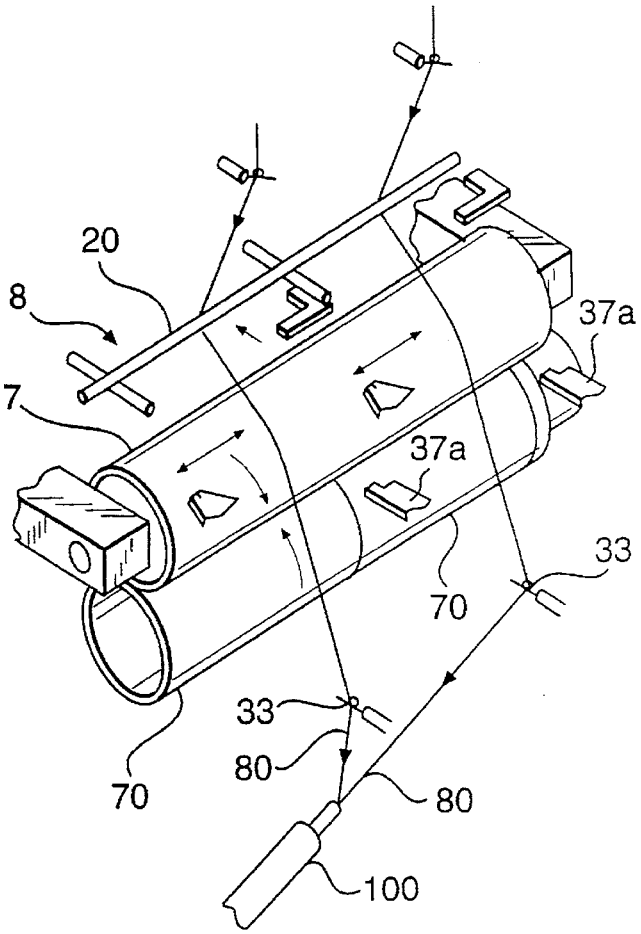
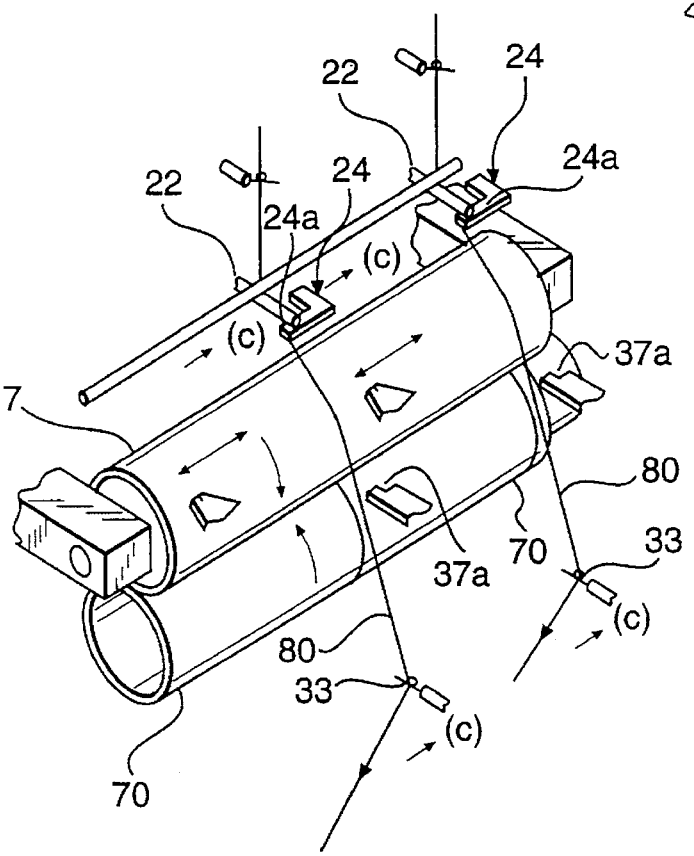
FIG. 14

FIG. 15
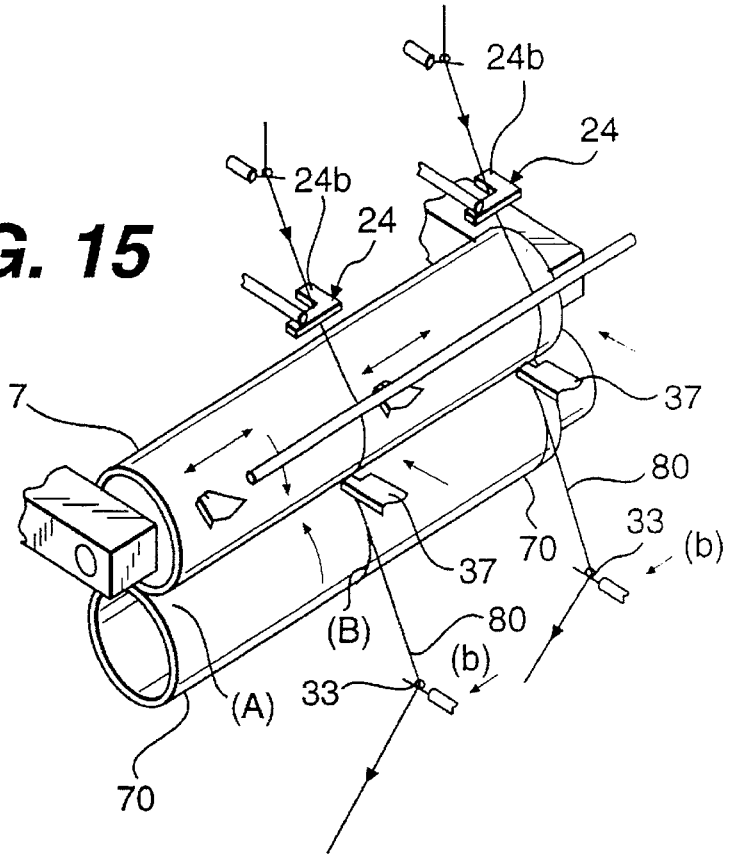
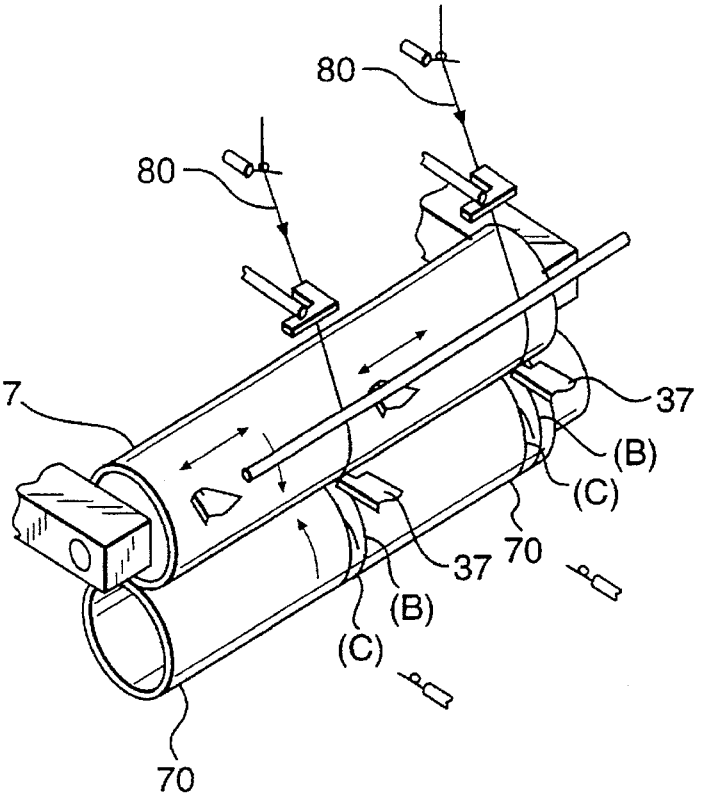
FIG. 16

FIG. 17
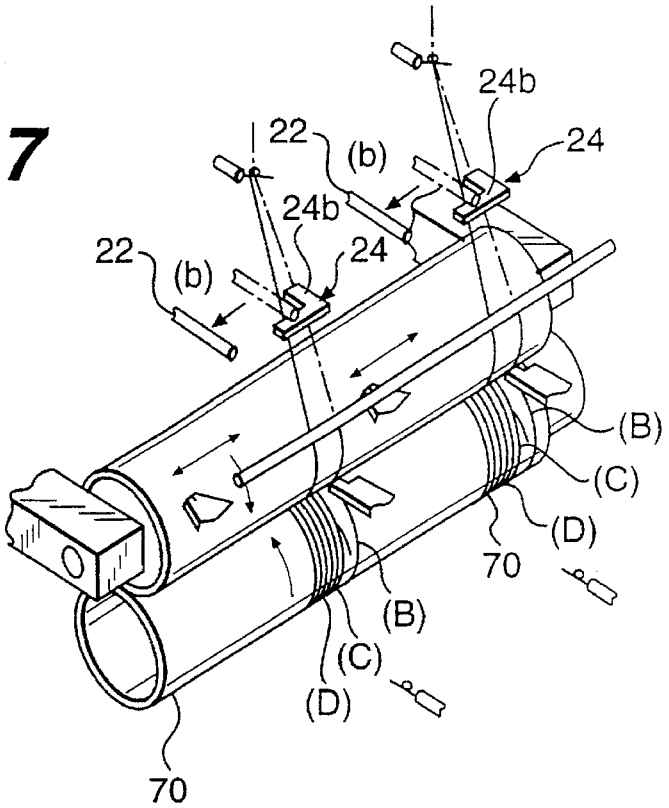
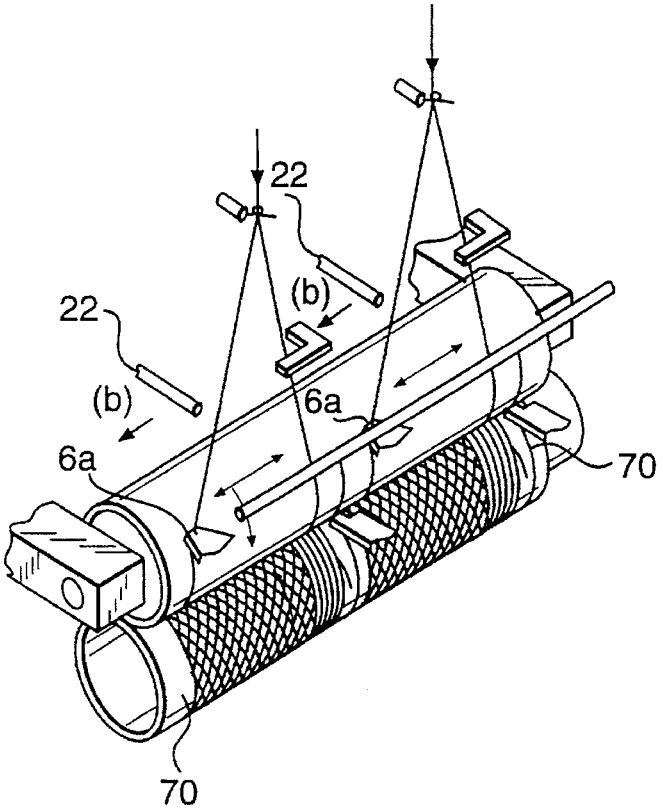
FIG. 18

YARN WINDING METHOD AND APPARATUS AND PACKAGE FORMED THEREBY

FIELD OF THE INVENTION

The present invention relates to a method for taking up a yarn on a bobbin formed of any kind of material, with an appropriate initial Winding, bunch winding and tail winding, a winder used therefor, a bobbin used therefor and a yarn package obtained by the method.

DESCRIPTION OF THE RELATED ART

In general, synthetic fiber yarns spun from a spinning machine are taken up by a turret type winder such as disclosed in Japanese Unexamined Patent Publication (Kokai) No. 62-280172.

The abovesaid turret type winder rotatably carries a plurality, of spindles, and comprises a turret member rotatably secured on a machine frame, a traverse mechanism provided above the spindle, a contact roller for applying a predetermined pressure in a contacting manner to a bobbin fixedly carried on the spindle or a yarn layer section wound on the bobbin, an upper yarn-switching mechanism provided above the traverse mechanism or the contact roller, a lower yarn-switching mechanism provided between a full bobbin and an empty bobbin, for restricting a yarn path when switching the yarn from the full bobbin to the empty bobbin, a threading mechanism provided beneath the lower yarn-switching mechanism, for restricting a yarn path when the yarn is wound on the empty bobbin, and an initial-winding forming mechanism movable between the empty bobbin and the lower yarn-switching mechanism or between the empty bobbin and the threading mechanism, for forming the initial winding on the empty bobbin.

When a yarn is taken up by the abovesaid turret type winder, a bobbin 75 made of paper is used, having a yarn-catching groove 75A at one end thereof, consisting of a yarn introduction part 75*a* having a V-shaped cross section and a yarn-catching part 75*b* having a thinner cross section, as shown in FIGS. 44 and 45.

In order to prevent the yarn caught by the yarn-catching groove from escaping, the opposite side walls of the yarn-catching part 75*b* are brought into tight contact with each other by collapsing the outer periphery of the bobbin 75, as shown in FIG. 46.

When initiating the yarn take-up operation while using such a bobbin 75, a plurality of yarns spun from a spinning machine (not shown) are sucked into a suction gun (not shown), each of which is inserted to a first yarn path restricting guide of the threading mechanism, after a yarn-removing guide of the upper yarn-switching mechanism has come out to move the first yarn path restricting guide to a position at which the initial-yarn winding operation is conducted- Then a yarn-pushing guide of the first yarn-switching mechanism moves toward one end of an empty bobbin to convey the respective yarn thereby onto a vertical line passing a position of the respective bobbin at which a bunch winding is to be formed.

Next, when a yarn-winding guide of the initial-winding forming mechanism moves to a yarn-running position to bring the yarn which is moving while being guided by the yarn-pushing guide and the first yarn path restricting guide of the threading mechanism, into contact with the empty bobbin, the yarn engages with the yarn-catching groove of the empty bobbin and is caught thereby, due to the movement of the yarn-winding guide in the lengthwise direction of the empty bobbin. Then, the yarn-running direction is abruptly reversed, whereby the yarn is broken by a tensile force applied thereto due to the suction of the suction gun (not shown) and the drag of the empty bobbin and a fresh yarn continuously delivered from the contact roller is wound in the yarn-catching groove of the empty bobbin. Since the yarn is guided by the yarn-pushing guide to run toward a position at which a bunch-winding is to be formed, the yarn is wound at this predetermined position as a bunch-winding while moving along the outer periphery of the empty bobbin.

When a yarn is switched from a full bobbin to a fresh empty bobbin after a predetermined amount of yarn has been taken up on the bobbin 75, the turret member rotates to move the full bobbin from a yarn-winding position to a doffing position and, on the contrary, to move the empty bobbin from the doffing position to the yarn-winding position.

When the yarn is removed from the traverse guide by the yarn-removing guide of the upper yarn-switching mechanism and conveyed to a bobbin end by the yarn-pushing guide, a second yarn path restricting guide of the lower yarn-switching mechanism moves to a position between the full bobbin and the empty bobbin to guide the yarn winding on the full bobbin to the bunch-winding position.

Then the yarn-winding guide of the initial-winding forming mechanism moves between the empty bobbin and the second yarn path restricting guide of the initial-winding forming mechanism to bring the yarn which is running while being restricted by the yarn-pushing guide of the upper yarn-switching mechanism and the second yarn path restricting guide of the lower yarn-switching mechanism, into contact with outer periphery of the empty bobbin. Thereupon, the yarn engages with the yarn-winding guide, moves therewith along the lengthwise direction of the empty bobbin, and is finally caught by the yarn-catching groove. When the yarn is caught, the yarn is abruptly broken because both the full and empty bobbins rotate in the same yarn-winding direction, and thus the yarn is switched from the full-bobbin to the empty bobbin.

Since the yarn is guided by the yarn-pushing guide to move toward the bunch-winding position of the empty bobbin, the bunch-winding is formed at this predetermined position while the yarn is moved from the yarn catching groove to the outer periphery of the empty bobbin.

Since a yarn path formed by the yarn-pushing guide of the upper yarn-switching mechanism and the first yarn path restricting guide of the threading mechanism, or the yarn-pushing guide of the lower yarn-switching mechanism and the second yarn path restricting guide crosses the introduction part 75*a* of the yarn-catching groove 75A provided on the empty bobbin, the yarn is liable not to enter the yarn-catching part 75*b* even though the yarn runs while contacting the introduction part 75*a* of the yarn-catching groove 75A. Also, even though an operation for detecting the yarn-catching groove is conducted by moving the yarn-winding guide in the lengthwise direction of the empty bobbin 75, the yarn does not assuredly enter the yarn-catching part 75*b* because the yarn does not move in a parallel state relative to the yarn-catching groove 75A in a similar manner to the above, thus deteriorating the yarn-switching operation.

Further, since a cross-section of the yarn-catching groove 75A of the bobbin 75 consists of a V-shaped section of the introduction part 75*a* and a tightly-contacting section of the yarn-catching part 75*b*, the yarn becomes fluffy due to the single-filament breakage caused by a burry surface of the collapsed yarn-catching part 75b, and part of such a yarn remains in the yarn-catching part 75b. Accordingly, there is a problem in that not only the bunch-winding yarn but also the fluffy yarn remaining while being caught by burrs of the yarn-catching part 75b must be removed.

In addition, when the yarn has once been wound on the bobbin 75, the yarn-catching groove 75A may deform, or even the outer periphery thereof may deform by the compression due to the tightening of wound yarn.

In such a bobbin 75, the yarn end firmly entering the yarn-catching groove 75A cannot completely be removed therefrom, and when such a bobbin is reused, the yarn may not be caught by the yarn-catching groove 75A making the yarn-switching operation fail. Further, yarn breakage may occur due to an abnormal winding speed caused by the deformed outer periphery of bobbin. Therefore, reuse of the bobbin may be impossible.

Alternatively, a bobbin without a yarn-catching groove may be adopted while using, as the yarn-catching groove during the yarn-switching operation, a contacting portion between the adjacent bobbins fixedly carried on a spindle or between one end surface of a bobbin and a side wall of a positioning shoulder of the spindle, and forming the bunch-winding at a position apart from the contacting portion. Since a yarn path formed by a yarn-pushing guide of an upper yarn-switching mechanism and a second yarn path restricting guide of a lower yarn-switching mechanism is not parallel to the contacting portion but intersects at a large angle, there is a problem in that the yarn is difficult to enter into the contact portion which lowers the rate of success of the yarn-switching operation.

To solve this problem, the yarn-switching operation may be conducted while providing the bunch-winding position closer to the contacting portion so that the intersecting angle of the yarn relative to the contacting portion is smaller to place the yarn substantially parallel to the latter. According to this method, the yarn can easily enter the contact portion to improve the rate of success of the yarn-switching operation. In this case, however, the bunch-winding may drop off the bobbin during the doffing operation or when the yarn package is handled in the succeeding process, since the bunch-winding is formed in the vicinity of the contacting portion or the side wall of bobbin end. Thus there is a problem of the disappearance of tail winding.

The above problems are not limited to a turret type winder but similarly occur in a yarn winder wherein a single spindle is provided and a full bobbin is replaced by an empty bobbin while stopping the spindle rotation.

In Japanese Unexamined Patent Publication (Kokai) No. 51-43411, a bobbin of the above-described type having no yarn-catching groove is proposed, wherein a yarn-introduction part having a U-shaped cross section and a yarn-catching part formed by the contacting side walls of bobbin ends are created when two bobbins abut to each other, or a yarn-catching part is created by abutting two bobbins, each having a slanted surface projected in the lengthwise direction from the outer peripheral edge to the inner peripheral edge thereof, having a V-shaped cross section formed of the slanted surfaces.

When the yarn-introduction part has a U-shaped cross section, the yarn caught thereby is not brought into contact with the vertical wall of the U-shaped groove, whereby a frictional force which causes the yarn to move to the outer periphery of the bobbin is not generated between the yarn and the wall. Accordingly, the Tarn tends to be wound in the U-shaped groove and must be removed therefrom by the operator during the doffing operation or the conveyance of the yarn package, to prevent the would yarn from hanging down. This also causes a large amount of waste yarn.

Further, there is a problem in that a mechanism for moving the yarn caught by the U-shaped groove, to a bunch-winding position must be additionally provided.

While, if the yarn-catching part has a V-shaped cross section, there is a difference between the outer diameter of the bobbin and the bottom diameter of the V-shaped groove, generally corresponding to a wall thickness of the bobbin.

Accordingly, when the yarn-switching operation is carried out in the turret type winder wherein a turret member on which a plurality of spindles fixedly carrying bobbins are rotatably mounted is made to rotate to move one spindle carrying the full package from the yarn-winding winding position to the doffing position and the other spindle carrying the empty bobbin from the doffing position to the yarn-winding position, the peripheral speed of the bottom of the yarn-catching V-shaped groove is lower by a value corresponding to the wall thickness than the peripheral speed of the bobbin, which causes the reduction of yarn tension to result in the failure of yarn-catching by the V-shaped groove.

Even though the yarn is caught thereby, the yarn is liable to be wound around a roller provided upstream of the winder due to the reduction of yarn tension.

As a result, the success rate of the yarn-switching operation from the full bobbin to the empty bobbin lowers to a value less than 10%.

On the other hand, a bobbin which can be reused is proposed in Japanese Examined Utility Model Publication No. 2-3477, having a stepped portion at one end for the connection to the adjacent bobbin.

When the yarn-winding operation is carried out while using such bobbins, the bunch-winding is formed on the boundary part between bobbins. If the respective full bobbins are doffed while being separated from each other, the bunch-winding is liable to come loose and entangle with other full packages during the transportation of full bobbins or the treatment of bunch-winding.

Alternatively, Japanese Examined Patent Publication No. 57-36233 discloses a turret type winder wherein the above second yarn path restricting guide is not provided but the spindle fixedly carrying the full bobbin or empty bobbin is displaceable in the lengthwise direction. The yarn-switching operation from the full bobbin to the empty bobbin is conducted so that the yarn runs to a yarn-catching groove of the empty bobbin and a bunch-winding position on a yarn layer section of the full bobbin by the action of the first yarn path restricting guide of the upper yarn-switching mechanism.

When the yarn-switching operation is conducted by this turret type winder, the yarn is liable to pass over the boundary part between bobbins before being firmly caught thereby if the spindle-movement speed is too high, resulting in the lowering of the success rate of the yarn-switching operation. Contrarily, if the spindle-movement speed is too low, the yarn is liable to be spirally wound around the bobbin after being caught by the boundary part and before reaching the bunch-winding position, resulting in a problem that the spirally wound yarn comes loose to hang down from the full bobbin and entangles with other full bobbins.

The yarn path in the above yarn-switching operation is illustrated in FIG. 47, as seen from one end of the bobbin 75 in the lengthwise direction, wherein an angle θ' between a position Q' at which the yarn 80 is caught by the empty bobbin 75 and a position P at which the contact roller 7 is brought into contact with the bobbin 75 and the winding operation is initiated is in a range of 70° and 90°. Accordingly, the winding tension of the yarn 80 reduces until the yarn 80 is caught to initiate the winding operation, which causes the yarn 80 to be wound around a delivery roller disposed upstream of the winder, resulting in the lowering of the success rate of the yarn-switching operation.

To avoid the lowering of yarn tension during the yarn-switching operation, the rotational speed of the full bobbin may be set higher than the usual speed to increase the winding tension upon the yarn-switching.

That is, as shown in FIG. 49, in the method for temporarily increasing the yarn take-up speed, it is certainly understood that the yarn tension sharply increases. However, the yarn-switching operation often fails in this case since the yarn tension suddenly drops when the yarn is switched.

In FIG. 49, $T_1$ illustrates a variation of yarn tension while representing a yarn-winding period on the horizontal axis and a supply side yarn tension on the vertical axis, when the yarn speed increases by 2% at a yarn-switching instant.

As understood from graph $T_1$, since the rotational speed of bobbin increases immediately before instant $t_1$ for initiating the yarn-switching operation, the yarn tension also becomes gradually higher and, when the yarn is brought into contact with a bunch-winding guide at instant $t_2$, it reaches the maximum value. Then the yarn tension sharply falls at instant $t_3$ at which the yarn is actually broken, and thereafter, sharply increases if the yarn-switching is successful. Thus the yarn winding operation is normally continued.

In other words, it is understood that there is a risk of failure of the yarn-switching operation in the conventional method due to the sharp drop of yarn tension.

A first problem is that a bobbin having a V-shaped yarn-catching groove cannot always catch the yarn during the threading operation and the yarn-switching operation and further be repeatedly used.

A second problem is that in a bobbin forming a V-shaped or U-shaped yarn-catching part on the boundary between the adjacent bobbins, the yarn caught thereby cannot readily move to the outer periphery of the bobbin.

A third problem is that the success rate of the yarn-switching operation becomes worse due to the sharp fall of yarn tension in a period from the yarn being caught by the yarn-catching part to the initiation of yarn-winding operation.

A fourth problem is that the handling of full bobbin becomes difficult since the yarn end of the bunch-winding is not anchored and tends to hang down therefrom during the doffing or transportation of the full bobbin.

An object of the present invention is to solve the above problems of the prior art and provide a yarn winding method wherein the yarn-catching, bunch-winding and tail-winding are assuredly carried out even by using a bobbin made of synthetic resin or aluminum alloy having no yarn-catching groove thereon, a winder for carrying out the method, a bobbin used therefor and a yarn package obtained by the yarn winding method, which is free from the yarn hanging down from the bunch-winding and entangling with another package during the doffing operation and has an easily removable bunch-winding.

DISCLOSURE OF THE INVENTION

To solve the first and second problems of the present invention, a yarn winding method according to the present invention comprises the steps of engaging a running yarn with a yarn-catching part formed by a boundary part between ends of the adjacent bobbins fixedly carried on a spindle or a boundary part between one end of a bobbin and a side wall of a stepped portion of the spindle for positioning the bobbin, moving the yarn from the yarn-catching part to a bunch-winding position of the respective bobbin immediately after the yarn is caught by the yarn-catching part, forming a bunch-winding at the bunch-winding position, forming a predetermined tail-winding, and initiating the normal yarn winding operation while reciprocating the yarn by a traverse guide.

To solve the third problem, a winder according to the present invention comprises an upper yarn path restricting guide upstream of a contact roller, for guiding a running yarn to a bunch-winding position, and a yarn-winding guide for engaging the yarn running while being guided by the upper yarn path restricting guide with a yarn-catching part of an empty bobbin fixedly carried on a spindle, positioned in a concave space formed between the contact roller and the empty bobbin fixedly carried on the spindle.

To solve the first, second and third problems, a winder according to the present invention comprises an upper yarn path restricting guide upstream of a contact roller, for guiding a running yarn to a bunch-winding position, and a yarn-winding guide for engaging the yarn running while being guided by the upper yarn path restricting guide with a yarn-catching part of an empty bobbin fixedly carried on a spindle, positioned in a concave space formed between the contact roller and the empty bobbin; the yarn-catching part being formed by a boundary part between ends of the adjacent bobbins fixedly carried on a spindle or a boundary part between one end of a bobbin and a side wall of a stepped portion of the spindle for positioning the bobbin.

To solve the first and second problems, a yarn-winding bobbin according to the preset invention may have at least one end surface of a cylindrical hollow body, formed by an inner side wall generally perpendicular to a lengthwise axis of the cylindrical body and an outer slanted wall extending outward from the outer edge of the cylindrical body to the side wall and connected with the outer periphery of the cylindrical body via a circular cross-sectional wall having a radius of curvature of not more than 2 mm. Alternatively, the bobbin may have a structure wherein each of the opposite ends of a cylindrical body is formed by a side wall generally perpendicular to a lengthwise axis of the cylindrical body and wherein one of the side walls is connected with the outer edge of the cylindrical body via a circular cross-sectional wall having a radius of curvature of not more than 2 mm and the other of the side walls is connected with the outer edge of the cylindrical body via a circular cross-sectional wall having a radius of curvature larger than that of the former circular cross-sectional wall. Further, the bobbin may alternatively be formed of a cylindrical body of laminated paper wherein a side wall of the respective end or one end of the cylindrical body and the outer periphery of the cylindrical body in the vicinity thereof are covered with a protective member.

To solve the fourth problem, a yarn package according to the present invention is formed on a bobbin having at least one end surface of a cylindrical hollow body, formed by an inner side wall generally perpendicular to a lengthwise axis of the cylindrical body and an outer slanted wall extending outward from the side wall and connected with the outer periphery of the cylindrical body via a circular cross-sectional wall having a radius of curvature of not more than 2 mm, while sequentially forming from the end of the cylindrical body a bunch-winding for anchoring a yarn end, a tail-winding and substantial yarn-layers. The yarn package may be formed on a bobbin having a structure wherein each of the opposite ends of a cylindrical body is formed by a side wall generally perpendicular to a lengthwise axis of the cylindrical body and wherein one of the side walls is connected with the outer edge of the cylindrical body via a circular cross-sectional wall having a radius of curvature of not more than 2 mm and the other of the side walls is connected with the outer edge of the cylindrical body via a circular cross-sectional wall having a radius of curvature larger than that of the former circular cross-sectional wall, while sequentially forming from the end of the cylindrical body a bunch-winding for anchoring a yarn end, a tail-winding and substantial yarn-layers. Alternatively, the yarn package may be formed on a bobbin formed of a cylindrical body of laminated paper wherein a side wall of the respective end or one end of the cylindrical body and the outer periphery of the cylindrical body in the vicinity thereof are covered with a protective member, while sequentially forming from the end of the cylindrical body a bunch-winding for anchoring a yarn end, a tail-winding and substantial yarn-layers.

BRIEF DESCRIPTION OF THE DRAWINGS

FIGS. 13 through 18 are fragmentary perspective views illustrating the sequential steps, respectively, at an initial stage of the yarn winding operation of the first yarn winder according to the present invention;

DETAILED DESCRIPTION OF THE PREFERRED EMBODIMENT

A yarn-winding method and a yarn package obtained thereby will be described in detail below with reference to the drawings.

Since the yarn-winding method according to the present invention has the above technical composition, when a yarn engages with a yarn-catching part formed in a boundary area between end surfaces of bobbins abutting to each other or in a boundary area between a side wall of a positioning shoulder and an end surface of a bobbin abutting each other, the yarn immediately moves from the yarn-catching part to the respective bunch-winding position to form a bunch-winding on the bobbin.

Figure 1:
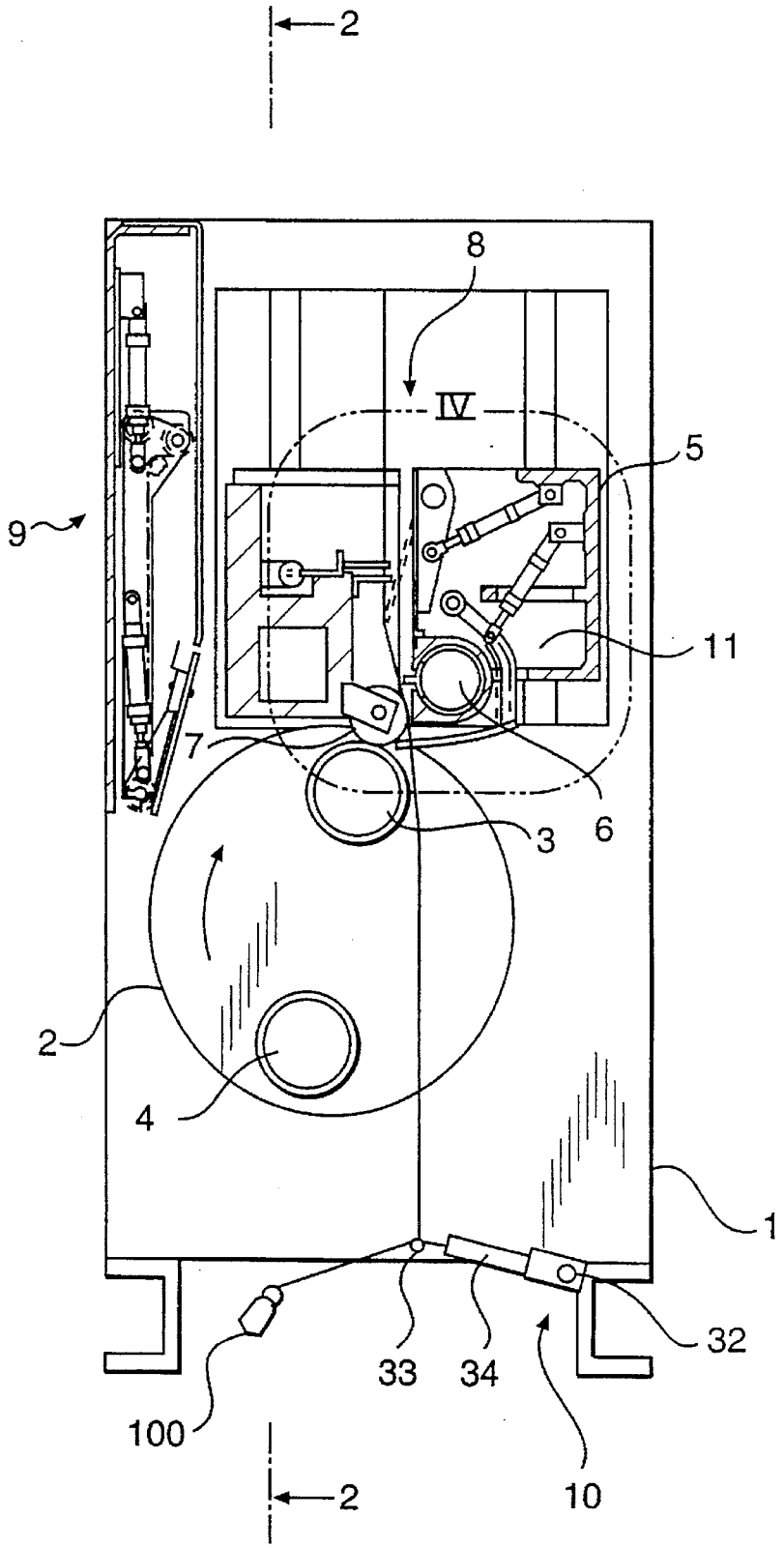
FIG. 1 is a schematic front view of a first embodiment of a yarn winder according to the present invention.
Figure 2:
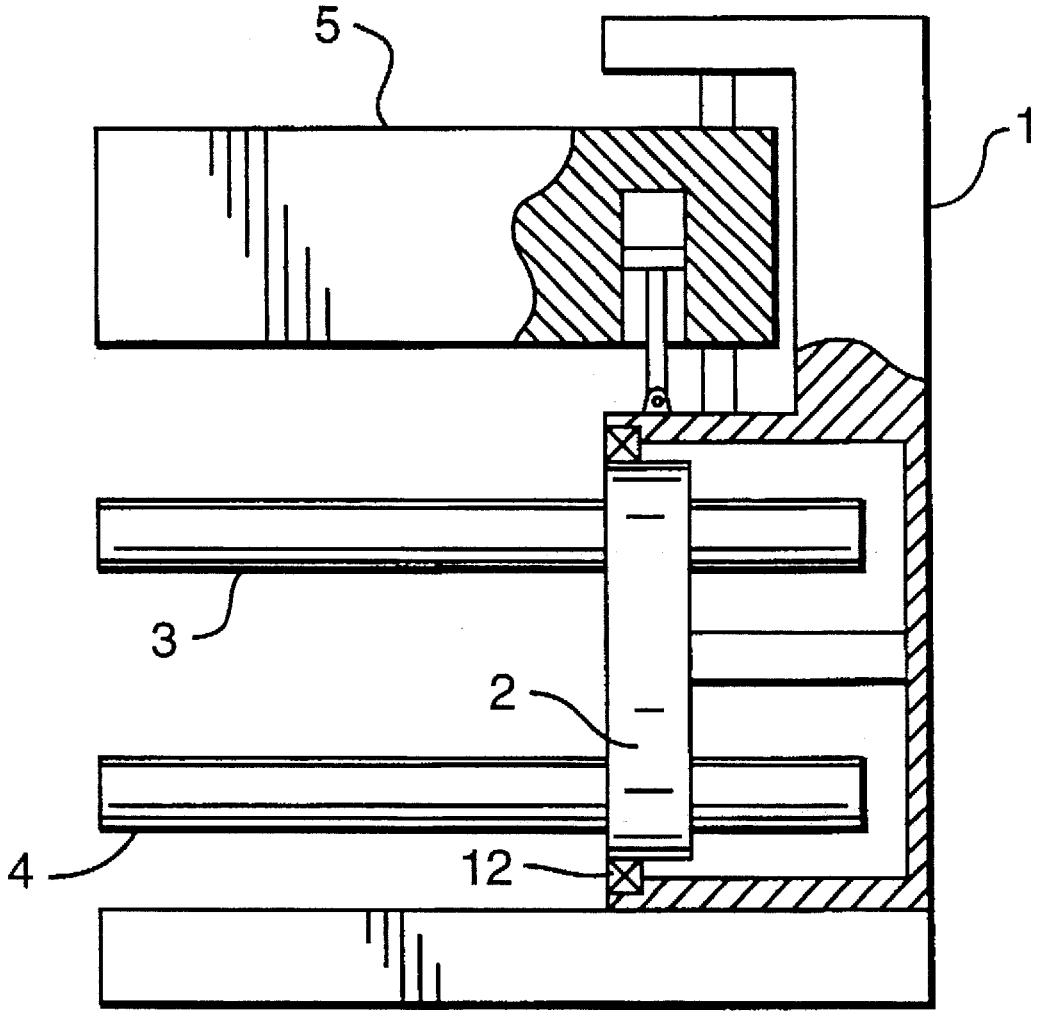
FIG. 2 is a cross section taken along a line 2—2 of FIG. 1.
Figure 4:
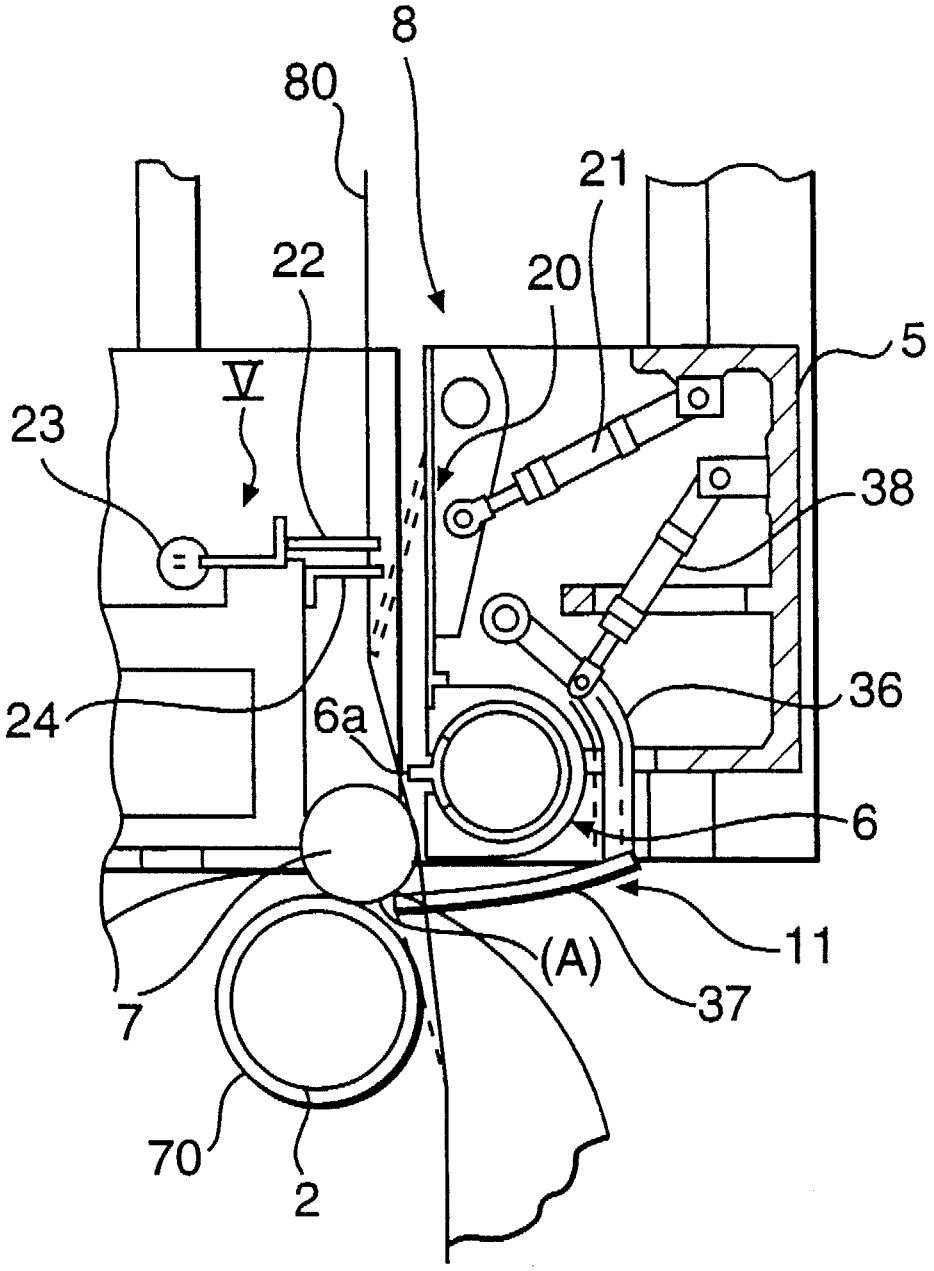
FIG. 4 is an enlarged view of area IV of FIG. 1.

FIG. 1 is a schematic front view of one embodiment of a turret type yarn winder according to the present invention, and FIG. 2 is a schematic side view thereof, wherein the yarn winder is structured by a turret member 2 carried on a machine frame 1 in a rotatable manner, spindles 3, 4 carried on the turret member 2 in a rotatable manner for fixedly mounting bobbins, a traverse mechanism 6 carried on a frame 5 movable in the vertical direction above the spindles 3, 4, a contact roller 7 carried on the frame 5 in a rotatable manner, an upper yarn-switching mechanism 8 provided above the traverse mechanism 6, a lower yarn-switching mechanism 9 carried on the machine frame 1 to be movable between a full bobbin 71 and an empty bobbin 70 (FIG. 21), threading mechanism 10 carried on the machine frame 1 beneath the lower yarn-switching mechanism 9, for restricting a yarn path to wind the yarn onto the empty bobbin at the initial stage of the yarn winding operation, and an initial yarn-winding forming mechanism 11 carried on the frame 5 to be movable to a concave space A, as shown in FIG. 4, formed by the contact roller 7 and the empty bobbin 70 located at a yarn-winding position.

The turret member 2 is mounted on the machine frame 1 in a rotatable manner via a bearing 12 and is driven to rotate by 180° in the direction (a) by a drive means (not shown) when the bobbin fixedly carried on the spindle 3 located at the yarn-winding position becomes full, to bring the full bobbin to the doffing position, while bringing the spindle 4 fixedly carrying the empty bobbin located at the doffing position to the yarn-winding position.

Figure 3:
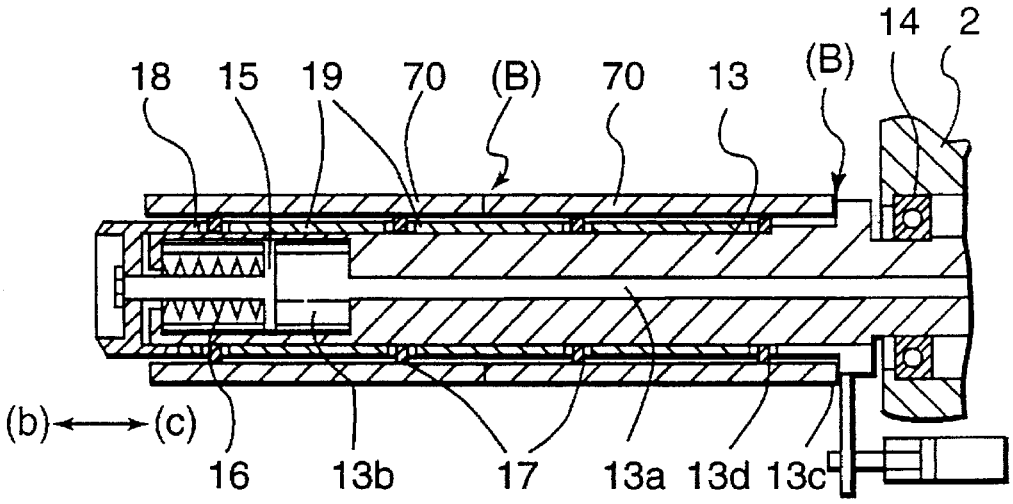
FIG. 3 is a cross section illustrating a detailed structure of a spindle of FIG. 1.

The structure of the spindle 3 or 4 is illustrated in FIG. 3, including a shaft 13 rotatably supported on the turret member 2 by a bearing 14, a piston 15 movably mounted in a pressurized air chamber 13*b* formed in a distal end portion of the shaft 13, a spring 16 for pushing the piston 15 to the support side, fixing rings 17 fitted onto the outer periphery of the shaft 13, and tubular bodies 18, 19, wherein an output shaft of a motor (not shown) is coupled to a base end of the shaft 13.

Figure 8:
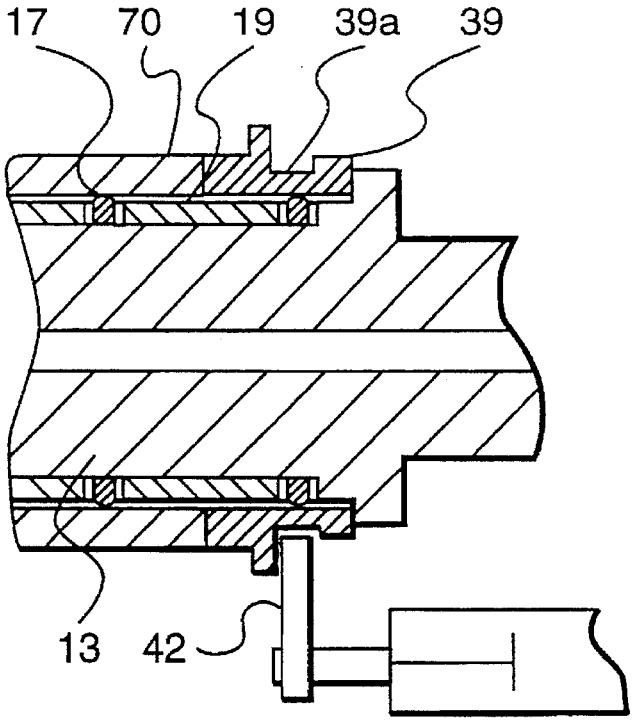
FIG. 8 is a schematic view of a second embodiment of a spindle in the yarn winder according to the present invention.

A central hole 13*a* for supplying pressurized air is provided in the shaft 13 along the axis thereof, to which a pressurized air supplying pipe (not shown) with a solenoid valve is connected. In the end portion on the support side, the shaft 13 has shoulders 13*c* and 13*d* on the periphery thereof for abutting to the bobbin and the fixing ring, respectively. It may be possible to provide a ring 39 fitted onto the end portion of the shaft 13, having a groove 39*a*, into which a pushing piece 42 for pushing the bobbin is engaged as shown in FIG. 8, instead of providing the shoulder 13*d* for abutting to the fixing ring.

When the pressurized air is supplied to the hole 13*a* of the shaft 13, a pushing force acting on the piston 15 is moved the same in the direction (b) to eliminate the pressure on the respective fixing ring 17, whereby the respective fixing ring 17 restores to its original size having an outer diameter smaller than an inner diameter of the empty bobbin 70. If the bobbin 70 is fitted onto the outer peripheries of the fixing rings 17 and the tubular bodies 18, 19 while maintaining this state and then the supply of the pressurized air to the hole 13*a* of the shaft 13 is interrupted, the piston 15 is moved in the direction (c) by the spring 16 to sequentially push the tubular body 18, the fixing ring 17, the tubular body 19 and the fixing ring 17, whereby the fixing rings 17 are widthwisely compressed to increase the outer diameter thereof and pressingly fix the inner periphery of the bobbin 70.

Figure 5:
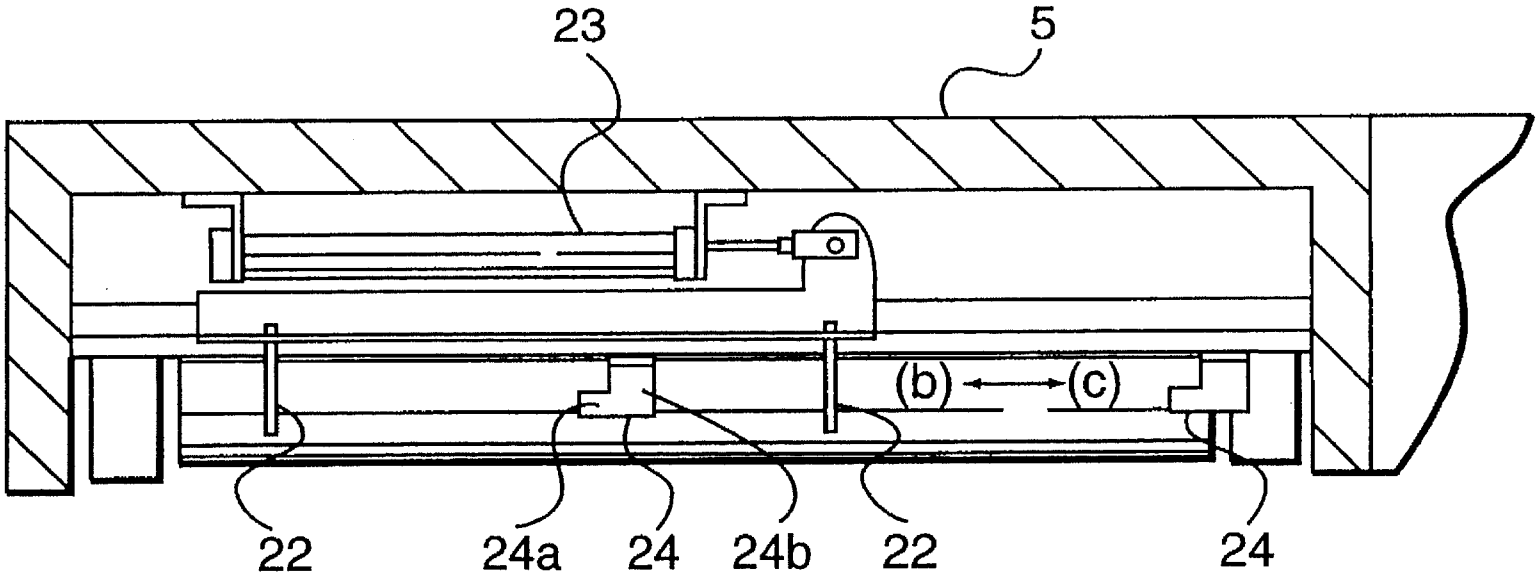
FIG. 5 is a view seen in the arrowed direction V of FIG. 4.

Details of the upper yarn-switching mechanism 8 are illustrated in FIGS. 4 and 5, including a yarn-removing guide 20 pivoted to the frame 5 above the traverse mechanism 6 to be displaceable in the yarn running direction and the direction perpendicular to the traversing direction, a yarn-pushing guide 22 provided on the frame 5 opposite to the yarn-removing guide 20 while intervening the running yarn therebetween and displaceable in the lengthwise direction of the empty bobbin 70 by a power cylinder 23, and a yarn-holding guide 24 mounted on the frame 5 to be located beneath the yarn-pushing guide 22 when the yarn-pushing guide 22 moves to a bunch-winding position and a tail-winding position of the empty bobbin 70 so that the yarn is held thereby. The yarn-holding guide 24 is of an L-shape having a yarn-holding section 24*a* and a guiding section 24*b* for guiding the yarn to the bunch-winding position.

When the bobbin located in the yarn-winding position becomes full, the yarn-removing guide 20 is made to project by the power cylinder 21 to push out the yarn from a traverse guide 6*a* of the traverse mechanism 6. Then the yarn-pushing guide 22 moves to an end (c) of the full bobbin 70' by the power cylinder 23, whereby the yarn removed from the traverse guide 6*a* is transported to the end of the empty bobbin 70 and guided by the yarn-holding guide 24 to a yarn-catching part B.

Figure 6:
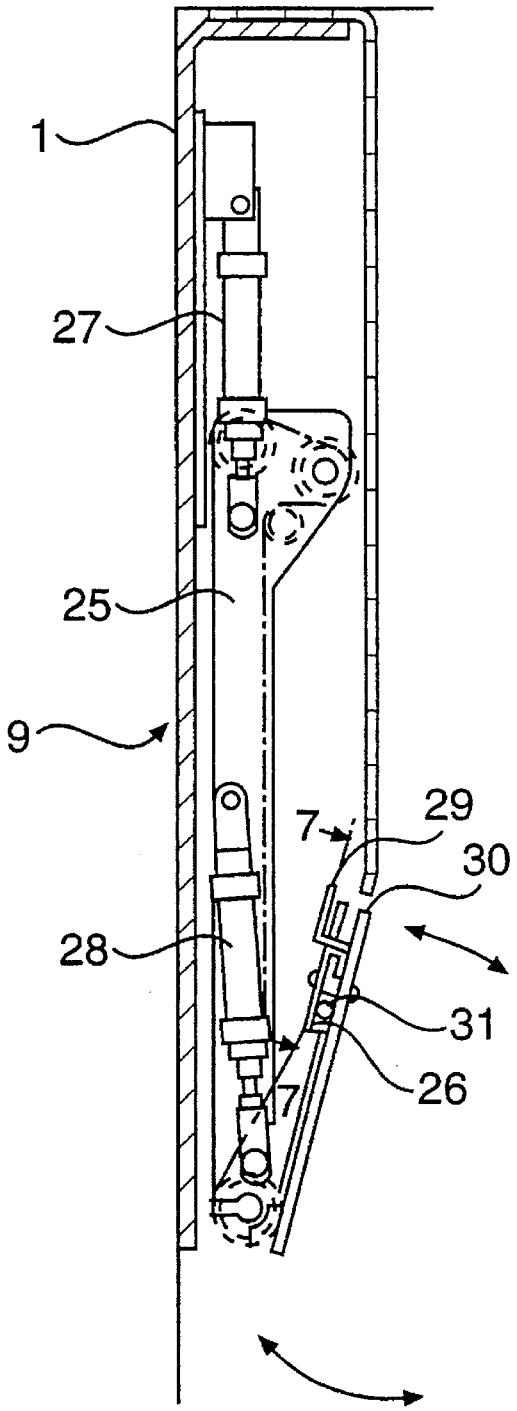
FIG. 6 is an enlarged view of a lower yarn-switching mechanism of FIG. 1.
Figure 7:
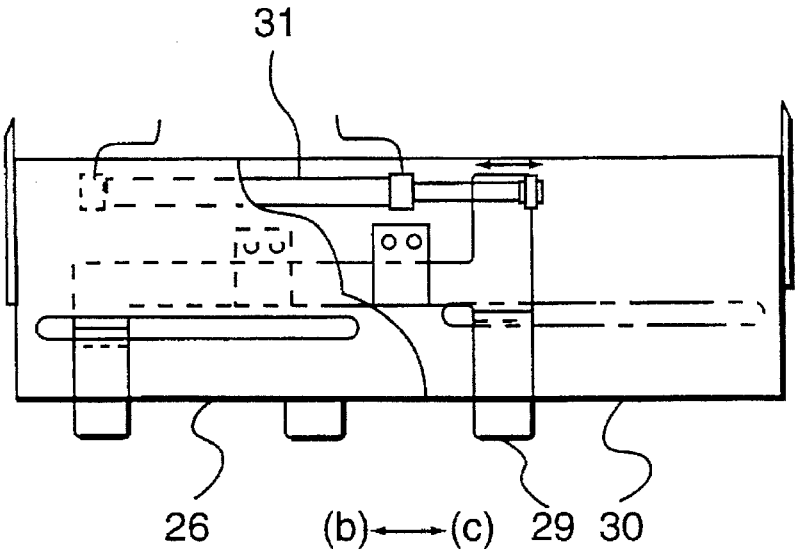
FIG. 7 is a cross section taken along a line 7—7 of FIG. 6.

The lower yarn-switching mechanism 9 has a structure shown in FIGS. 6 and 7, including an arm 25 pivoted to the machine frame 1, a section plate 26 pivoted to one end of the arm 25, a power cylinder 27 for pivoting the arm 25, a power cylinder 28 for rotating the section plate 26, a yarn-searching guide 29 provided on the upper side of the distal end of the section plate 26 to be movable in the lengthwise direction of the bobbin so that it is positioned on the empty bobbin side when the section plate 26 moves to the yarn-switching position, and a bunch-winding forming guide 30 provided on the lower side of the distal end of the section plate 26 to be positioned on the full bobbin side of the section plate 26 at the above state, wherein the yarn-searching guide 29 is movable in the lengthwise direction of the empty bobbin 70 by a power cylinder 31.

During the yarn-switching operation, the arm 25 first is moved by the power cylinder 27 to a position between the empty bobbin 70 located at the yarn-winding position and the full bobbin 70' located at the doffing position and then the section plate 26 follows this by the action of the power cylinder 28, so that the yarn 80 is guided by the bunch-winding forming guide 30 to a bunch-winding position in the yarn-layer section of the full bobbin 70'. Then the yarn-searching guide 29 moves in the lengthwise direction of the empty bobbin 70 to guide the yarn to run along a vertical line passing over the yarn-catching part B.

The threading mechanism 10 has a structure including a holding lever 32 pivoted to the machine frame 1 at a position beneath the lower yarn-switching mechanism 9 and movable in the lengthwise direction of the spindle, an arm 34 mounted to the lever 32 and having a threading guide 33 at one end thereof, and a power cylinder (not shown) for rotating the holding lever 32 to move the threading guide 33 between a threading position and a Waiting position.

When the yarn 80 is threaded to the threading guide 33 at the initial stage of the yarn-winding operation, the threading guide 33 is made to move together with the holding lever 32 by the power cylinder (not shown) toward the threading position so that yarn 80 is guided to pass over the yarn-catching part B.

As shown in FIG. 4, the initial-yarn winding mechanism 11 includes an arm 36 pivoted to the frame 5, a yarn-winding guide 37 carried at one end of the arm 36 to be located beneath the traverse mechanism 6, and a power cylinder 38 for rotating the arm 36. In FIGS. 13 and 14, the yarn-winding guide 37 has a guiding portion 37*a* such as a shoulder or a recess (not shown) preferably formed by ceramics or alumina for guiding the yarn to the yarn-catching part B.

While the yarn 80 runs along a yarn path restricted by the yarn-pushing guide 22, the yarn-holding guide 24 and the bunch-winding forming guide 30, the arm 36 is made to rotate by the power cylinder 38 to project the yarn-winding guide 37 into a concave space A between the contact roller 7 and the empty bobbin 70 located at the yarn-winding position so that the yarn 80 is guided to engage with the yarn-catching part B.

Each of the above power cylinders is connected to a pressurized air supply pipe (not shown) having a solenoid valve for switching a pressurized air supply path by a signal from a controller to extend and retreat the piston thereof.

The threading operation at the initial stage of the yarn winding operation will be described next with reference to FIGS. 13 through 18.

In the initial stage of the yarn winding operation in the turret type yarn winder, the yarn 80 spun from a spinning machine (not shown) is sucked by a suction gun 100 as shown in FIG. 13. When the yarn-removing guide 20 is projected, inserted into the threading guide 33 of the threading mechanism 10, the threading guide 33 moves in the arrowed direction (c) to the initial-yarn winding position, as shown in FIG. 14.

Then, the yarn-pushing guide 22 of the upper yarn-switching mechanism 8 moves to the end (c) of the empty bobbin 70 so that the yarn 80 is conveyed generally onto the vertical line passing over the bunch-winding position provided at the end of the empty bobbin 70.

Then, as shown in FIG. 15, the yarn-winding guide 37 of the initial-yarn-winding mechanism 11 is projected into the concave space A formed between the contact roller 7 and the empty bobbin 70 so that the yarn 80 is guided to pass over the yarn-catching part B formed by a boundary part between the ends of the adjacent empty bobbins 70 abutting each other and a boundary part between the end of the empty bobbin 70 and the end 13*c* of the shaft 13 abutting each other. If the yarn 80 runs directly over the yarn-catching part B, it instantly cuts into the yarn-catching part B and is caught thereby While, if the yarn 80 runs deviated from the yarn-catching part B, the yarn-catching guide 33 is moved in the direction (b) so that the yarn 80 cuts into the yarn-catching part B.

when the yarn 80 is caught by the yarn-catching part B by the above operation, an angle θ between a point Q at which the yarn 80 is caught by the empty bobbin 70 and a point P at which the contact roller 7 comes into contact with the empty bobbin 70 becomes smaller to a value in a range of 30° through 50° Accordingly, a period before the empty bobbin 70 starts the rotation to initiate the take-up operation of the yarn 80 is cut by half compared to the conventional case, for which period the winding tension is lowered.

Since both of the empty bobbin 70 and full bobbin 70' rotate in the same direction, i.e., the yarn winding direction, the yarn 80 is tensed and broken between both the bobbins 70 and 70'. Then as shown in FIG. 16, the yarn 80 caught by the yarn-catching part B is released from a recess 37*a* of the yarn winding guide 37 soon after the bobbin 70 rotates by a predetermined amount (30° through 50°) and tends to move toward a bunch-winding forming yarn path restricted by the guiding section 24*b* of the yarn-holding guide 24.

Figure 20:
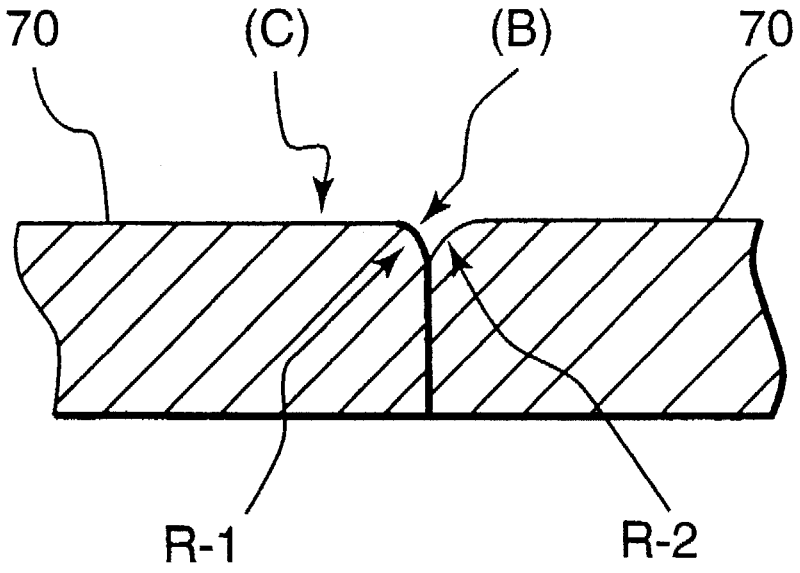
FIG. 20 is an enlarged view of a boundary part between bobbins for catching a yarn.

If the yarn catching part B is formed as shown in FIG. 20 to have an arcuate portion R-1 with a smaller radius of curvature on one side over which the yarn is transferred to the bunch-winding position and an arcuate portion R-2 with a larger radius of curvature on the opposite side, the width of the opening of the yarn-catching part B becomes large, whereby the yarn 80 easily cuts into the yarn-catching part B and is assuredly caught thereby. Also the yarn 80 released from the guiding shoulder of the yarn-winding guide 37 assuredly comes into contact with the arcuate portion R-1 with a smaller radius of curvature formed at the end of the empty bobbin 70, whereby the yarn 80 can easily ride on the outer periphery of the empty bobbin 70 and is moved to the bunch-winding forming position. Accordingly, a yarn length from the yarn-catching position in the yarn-catching part B to the bunch-winding starting position becomes short.

When the predetermined amount of bunch-winding C is formed, as shown in FIG. 17, the yarn-pushing guide 22 returns to the waiting position at a preset speed to form a tail-winding D. During this step, the yarn 80 slidingly moves on the holding section 24*b* of the yarn-holding guide 24 and is released from the yarn-holding guide 24 after the formation of tail-winding D.

Then the yarn 80 laterally moves to a fulcrum side of the traverse motion and is caught by the traverse guide 6*a* of the traverse mechanism 6 as shown in FIG. 18 to be subjected to a traverse motion, whereby the yarn 80 is wound on the empty bobbin 70.

Next, the yarn-switching operation from the full bobbin to the empty bobbin will be described with reference to FIGS. 21 through 26.

When a bobbin becomes full after a predetermined amount of yarn 80 has been wound thereon the turret member 2 is made to rotate to move the full bobbin 70' located at a yarn-winding position to a doffing position and, instead, to move an empty bobbin 70 located at the doffing position to the yarn-winding position.

Figure 21:
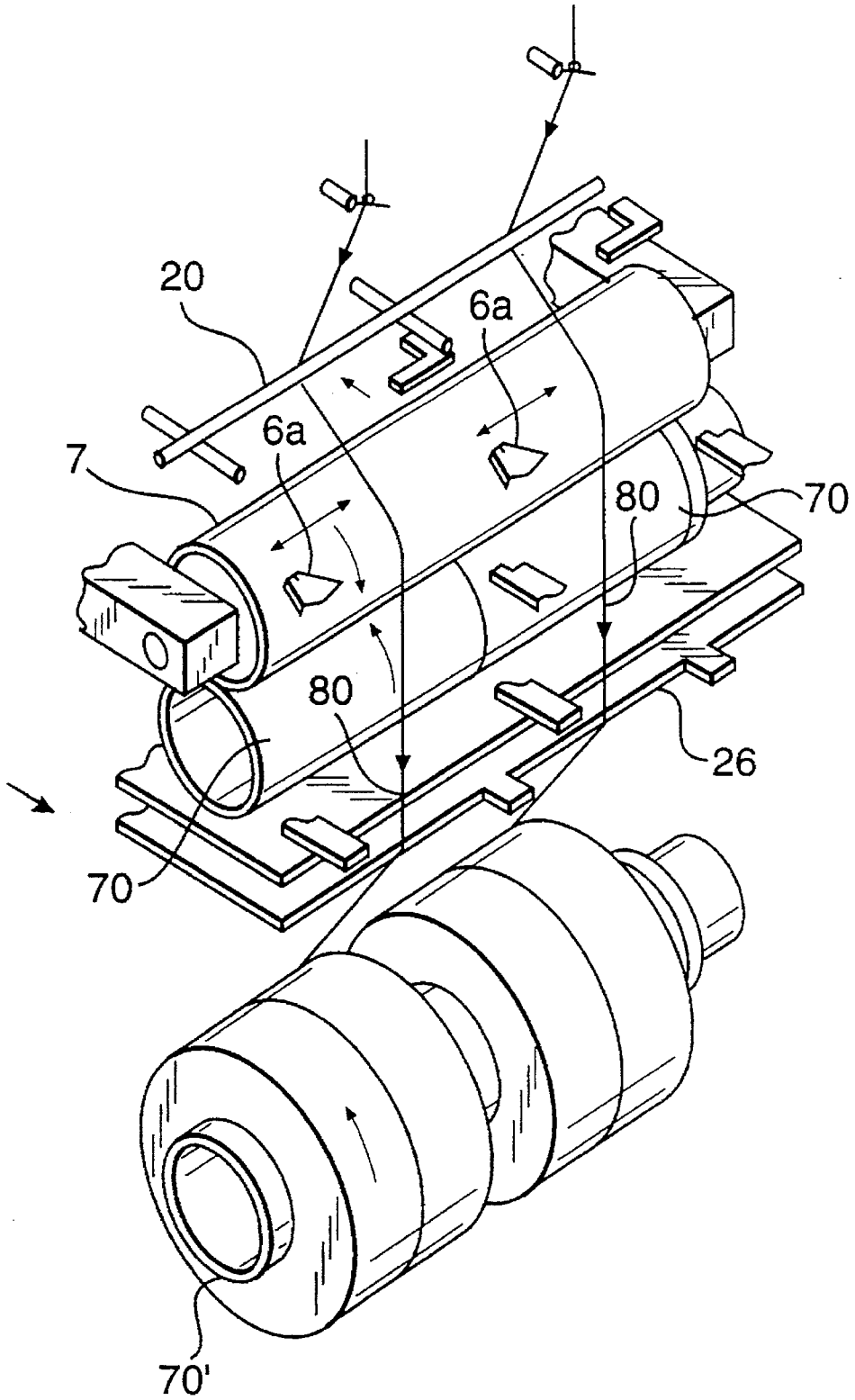
FIGS. 21 through 26 are fragmentary perspective views illustrating the sequential steps, respectively, of the yarn-switching operation of the first yarn winder.

Then as shown in FIG. 21, the arm 25 and the section plate 26 of the lower yarn-switching mechanism 9 is made to rotate to a position between the empty bobbin 70 and the full bobbin 70'. Simultaneously with this operation, the yarn-removing guide 20 of the upper yarn-switching mechanism 8 is moved perpendicular to the yarn running direction to release the yarn 80 from the traverse guide 6*a* of the traverse mechanism 6, whereby the yarn 80 laterally moves to a fulcrum side of the traverse motion.

Figure 22:
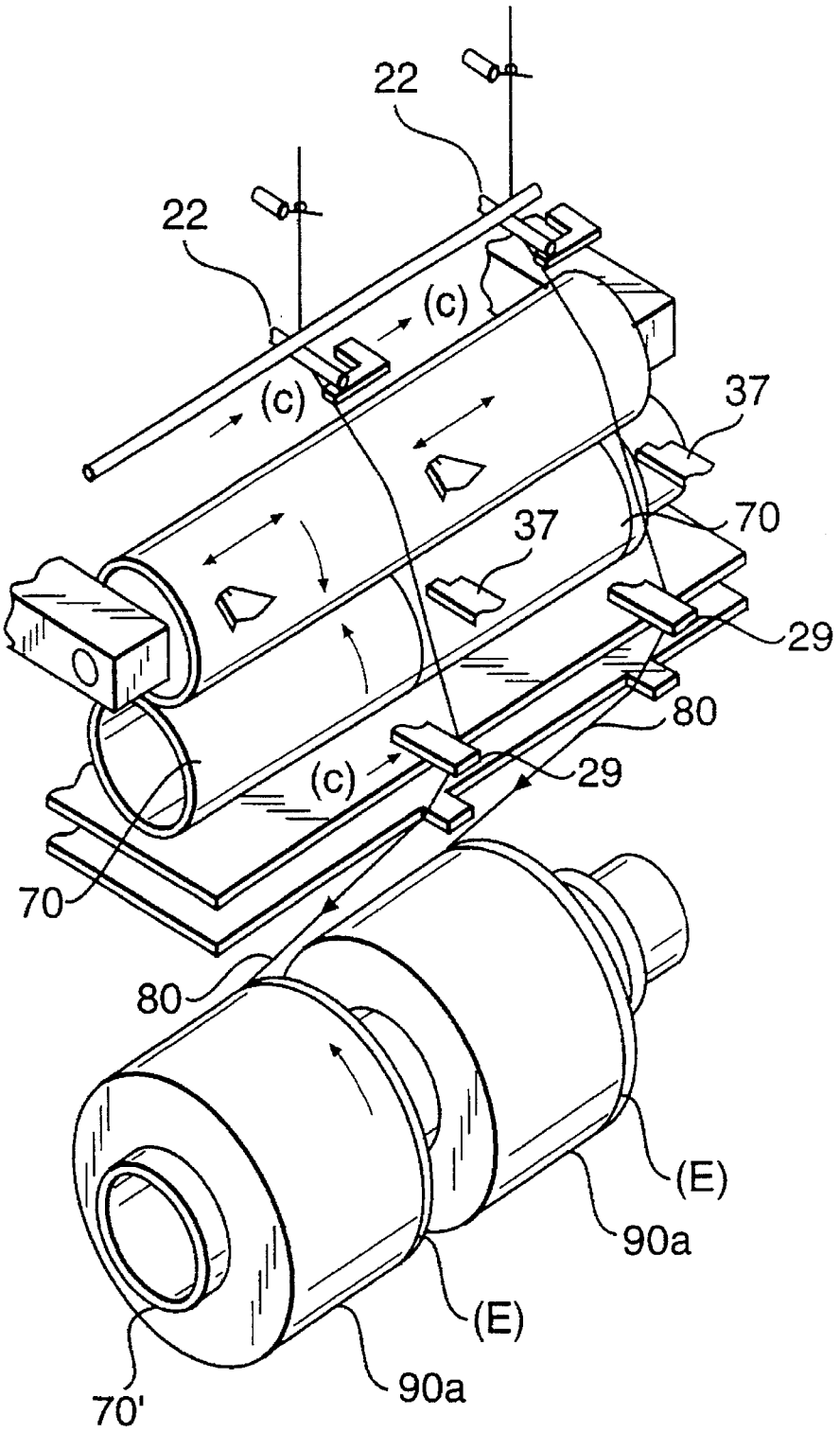

Then, as shown in FIG. 22, the yarn-pushing guide 22 catches the yarn 80 in the midway of movement in the direction (c) from the waiting position to convey the same to the bunch-winding forming position. Simultaneously with this operation, the yarn-searching guide 29 is moved in the direction (c)

The yarn-searching guide 29 moves to a position at which the yarn 80 can run on the vertical line common to that of the yarn-winding guide 37 of the initial-winding forming mechanism 11. At that time, the yarn runs toward the full bobbin 70' while being restricted by the bunch-winding forming guide 30, and forms a bunch-winding E on the yarn later section 90*a*.

Figure 23:
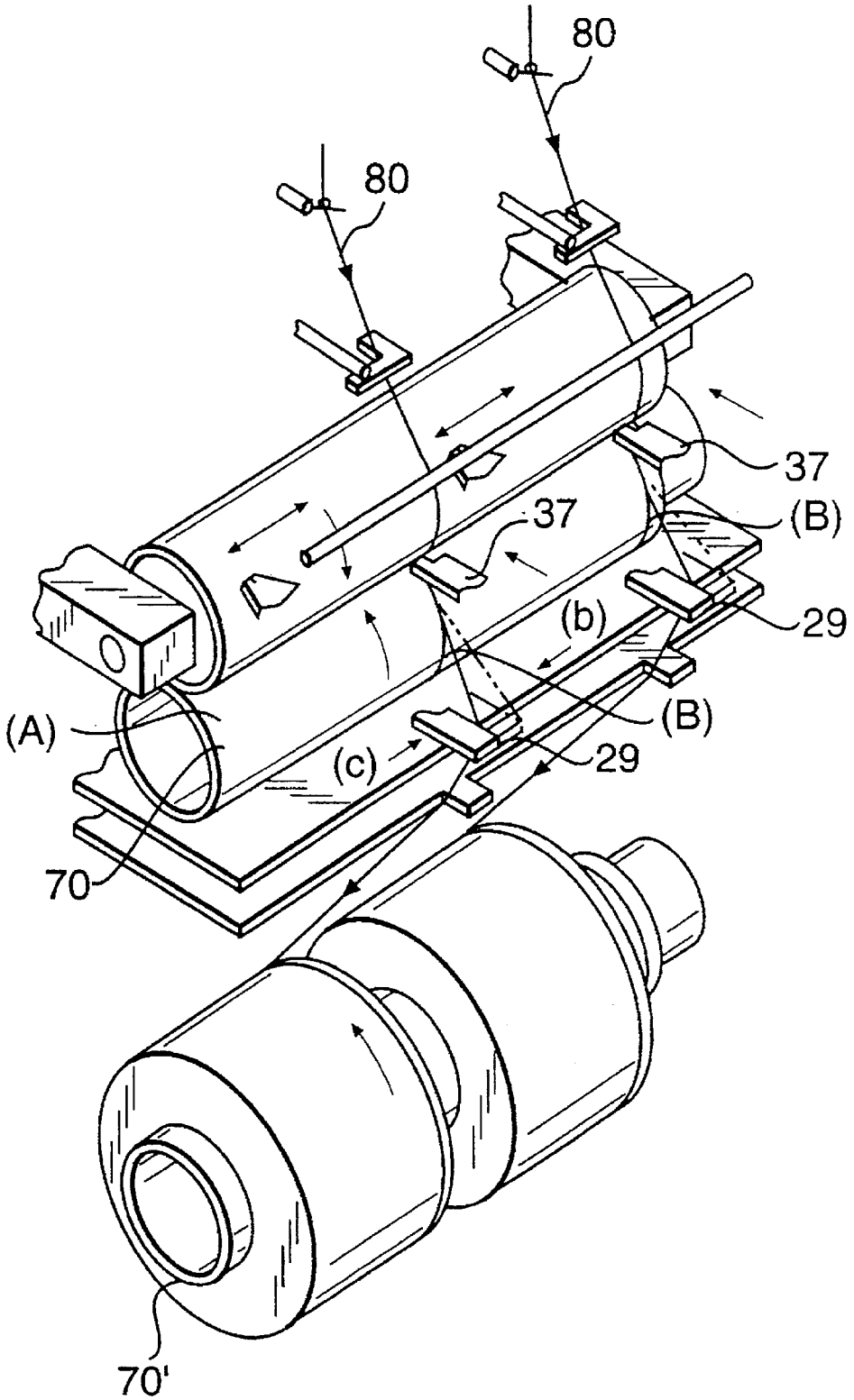

As shown in FIG. 23, the yarn-winding guide 37 of the initial-winding forming mechanism 11 projects into the concave space A formed by the contact roller 7 and the empty bobbin 70 located at the yarn winding position, whereby the yarn 80 is guided to engage with the yarn-catching part B formed by the boundary part between the ends of the adjacent empty bobbins 70 abutting each other and the boundary part between one end of the empty bobbin 70 and one end 12*c* of the shaft 12 abutting each other. At this time, if the yarn 80 runs at the same position as the yarn-catching part B, the yarn 80 instantly cuts into the yarn-catching part B and is caught thereby. While, if the yarn 80 runs deviated from the yarn-catching part B, the yarn 80 cuts into the yarn-catching part B and is caught thereby midway in the movement of the yarn-searching guide 29 in the direction (c).

Figure 19:
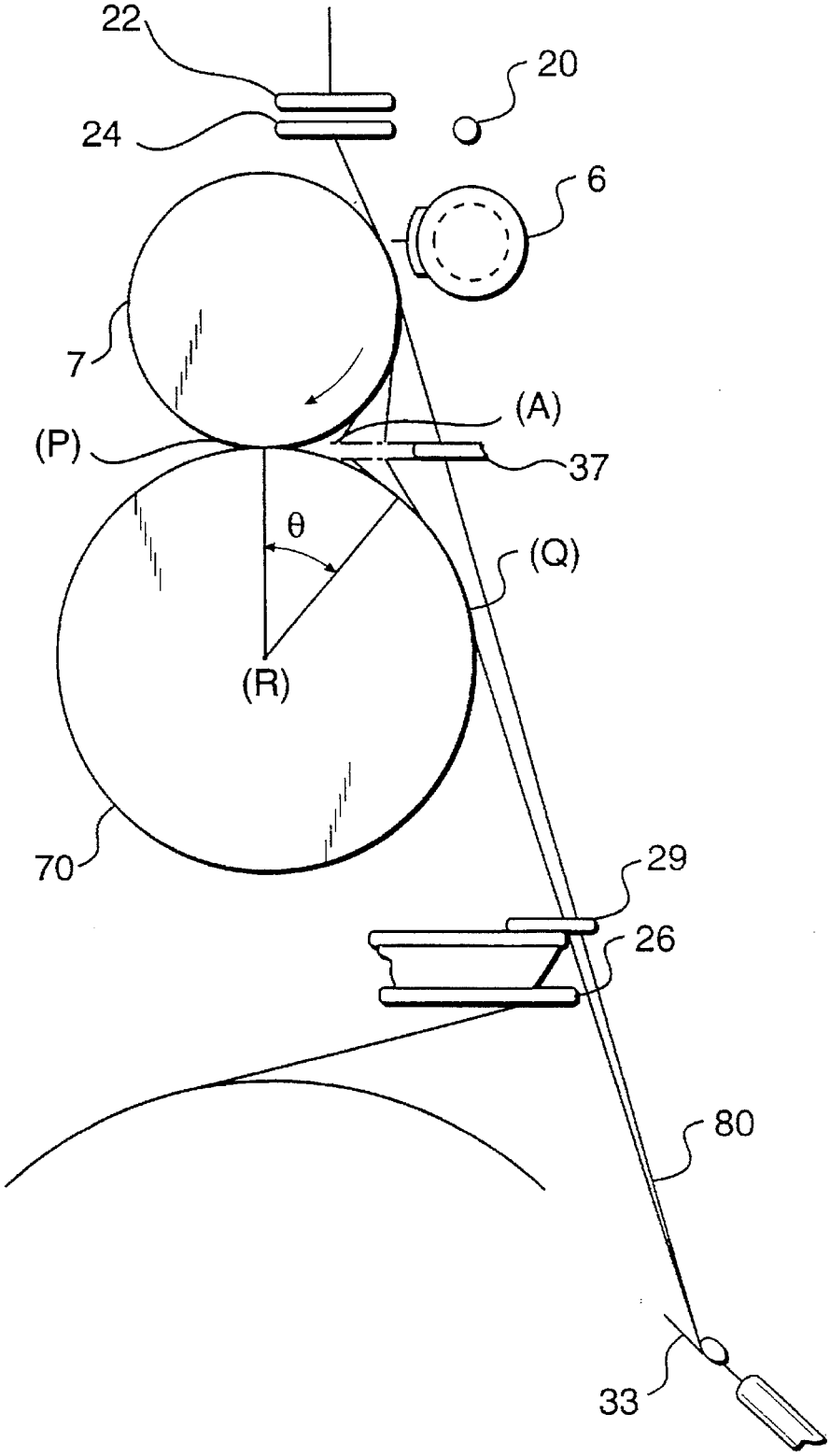
FIG. 19 illustrates a yarn path in the first yarn winder when a yarn is initially wound on a bobbin.
Figure 24:
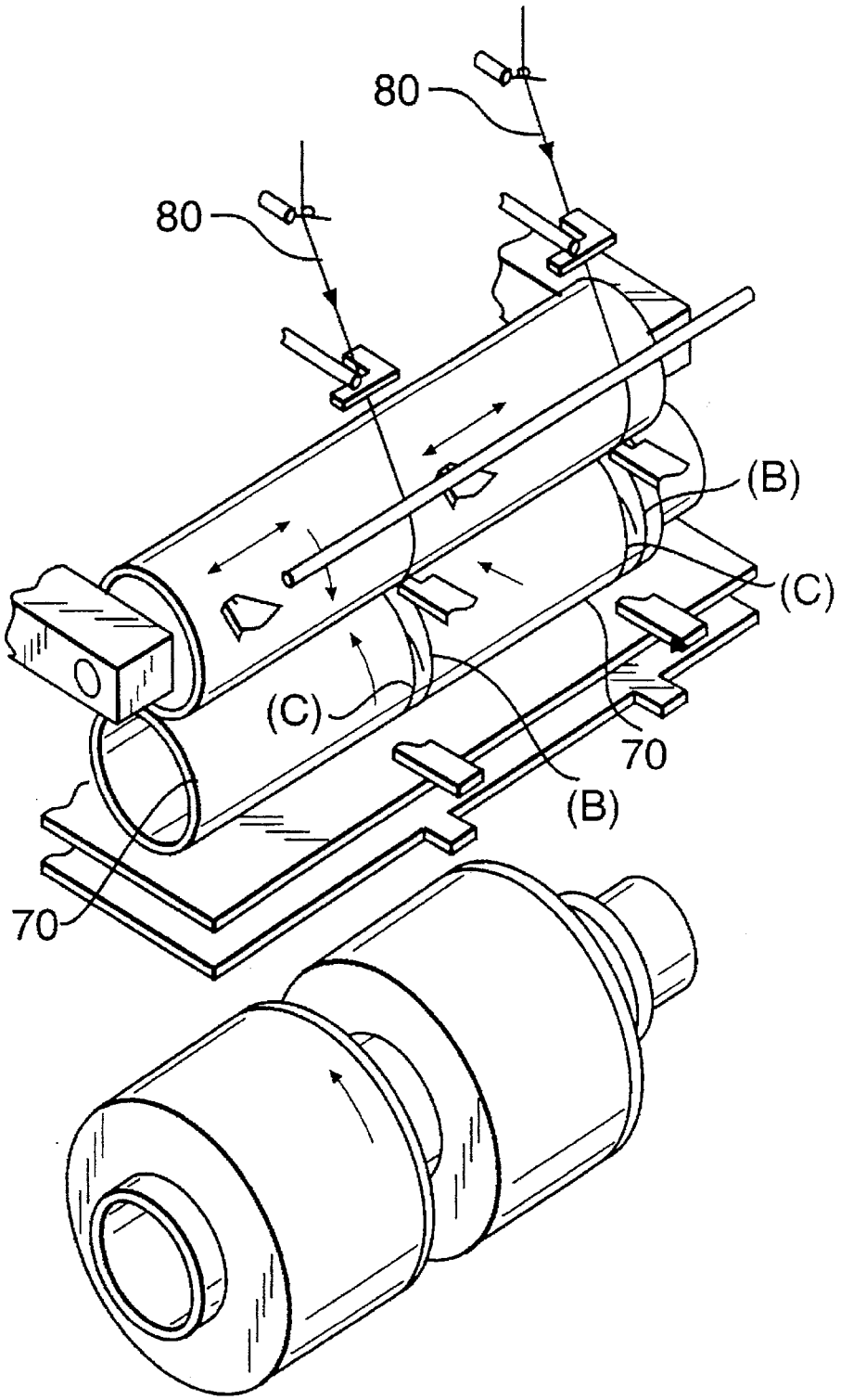

When the yarn 80 cuts into the yarn-catching part B and is caught thereby according the above operation, the yarn 80 is tensed and broken between the empty bobbin 70 and the full bobbin 70' because both the empty bobbin and full bobbin rotate in the same yarn-winding direction as shown in FIG. 19. The yarn 80 caught by the boundary part B as shown in FIG. 24 is soon released from the yarn winding guide 37 when the bobbin 70 rotates by a predetermined amount (30° through 50°), and conveyed to the bunch-winding forming position under the restriction of the guiding section 24*b* of the yarn-holding guide 24.

Figure 25:
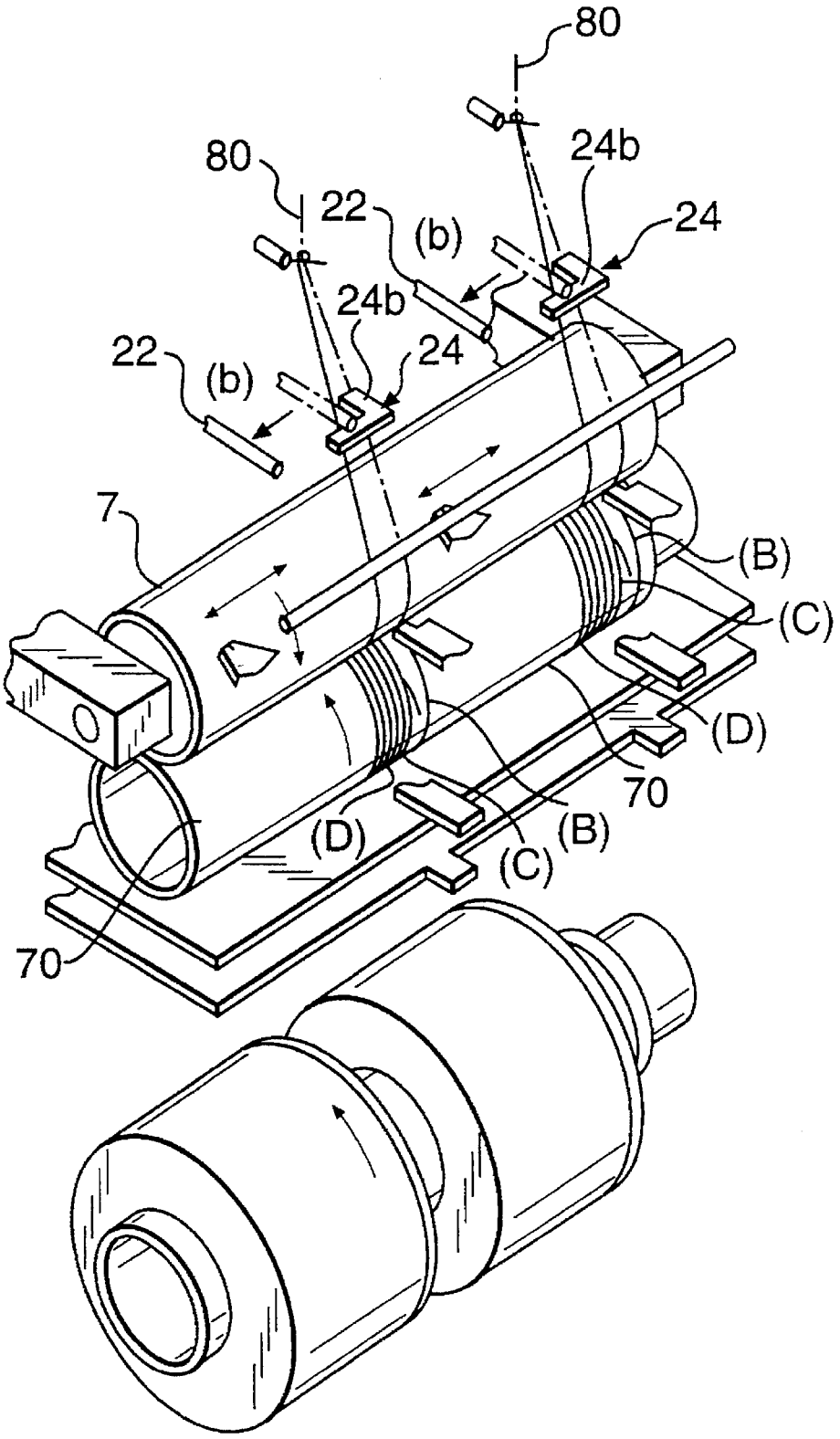

When a predetermined amount of bunch-winding C is formed, as shown in FIG. 25, the yarn-pushing guide 22 returns the waiting position at a predetermined speed to form the tail-winding. At that time, the yarn 80 slidingly moves on the holding section 24a of the yarn-holding guide 24 and releases from the yarn-holding guide 24 after the tail-winding has been formed.

Figure 26:
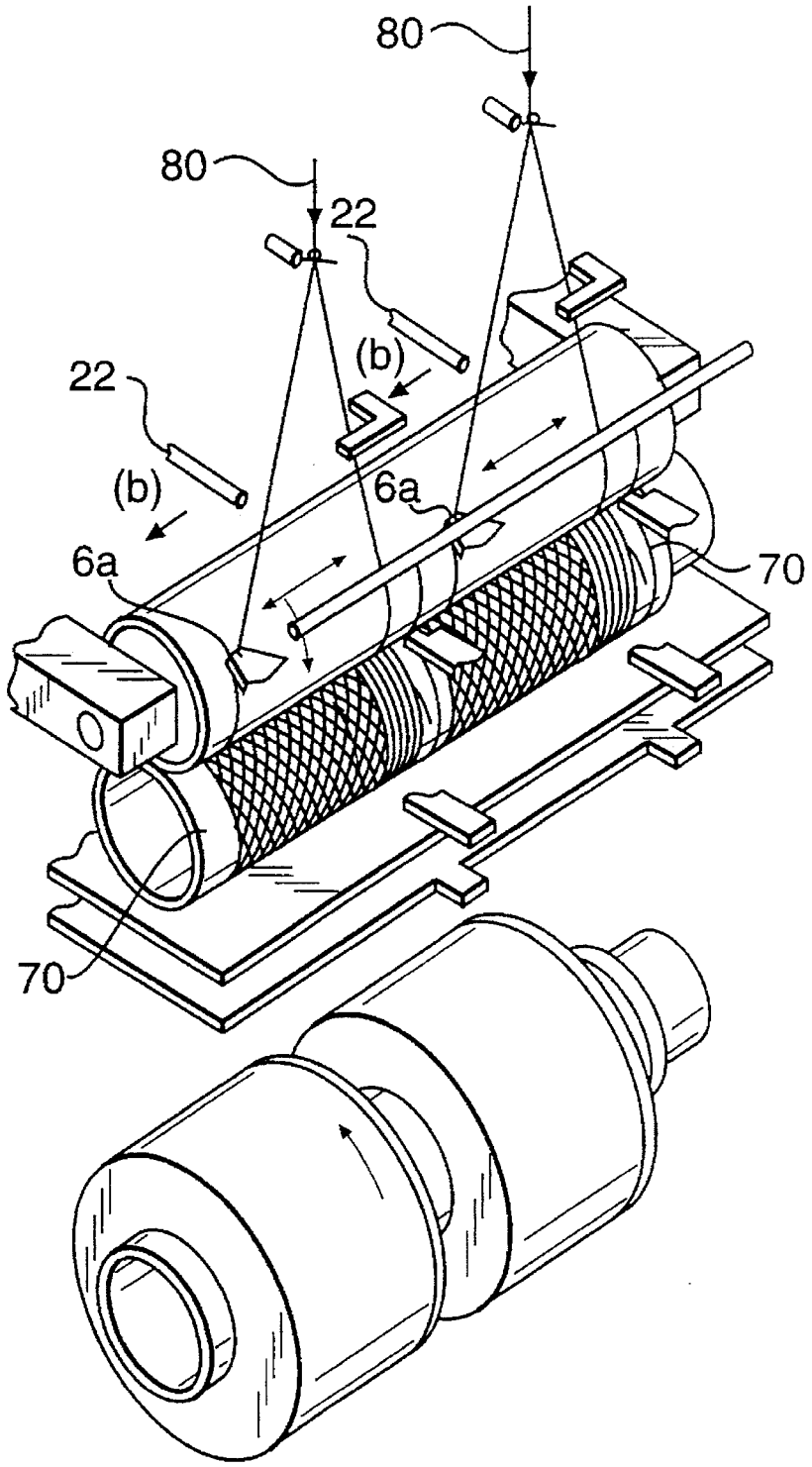

Then the yarn moves laterally to the fulcrum side of the traverse motion and is caught by the traverse guide 6*a* of the traverse mechanism 6 as shown in FIG. 26 to be subjected to the traverse motion so that the yarn 80 is wound on the empty bobbin 70.

Figure 27:
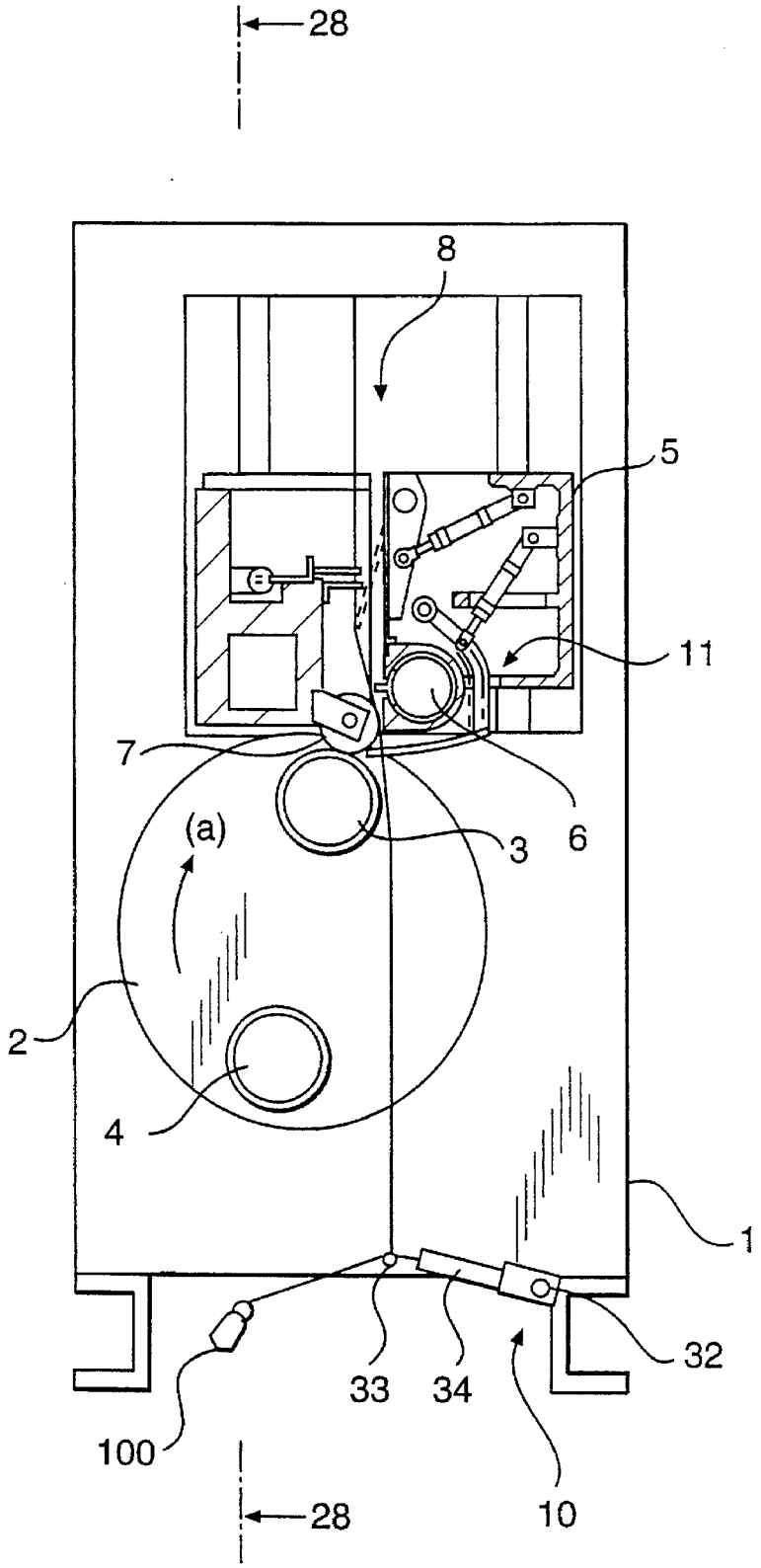
FIG. 27 is a front view of a second embodiment of a yarn winder according to the present invention.
Figure 28:
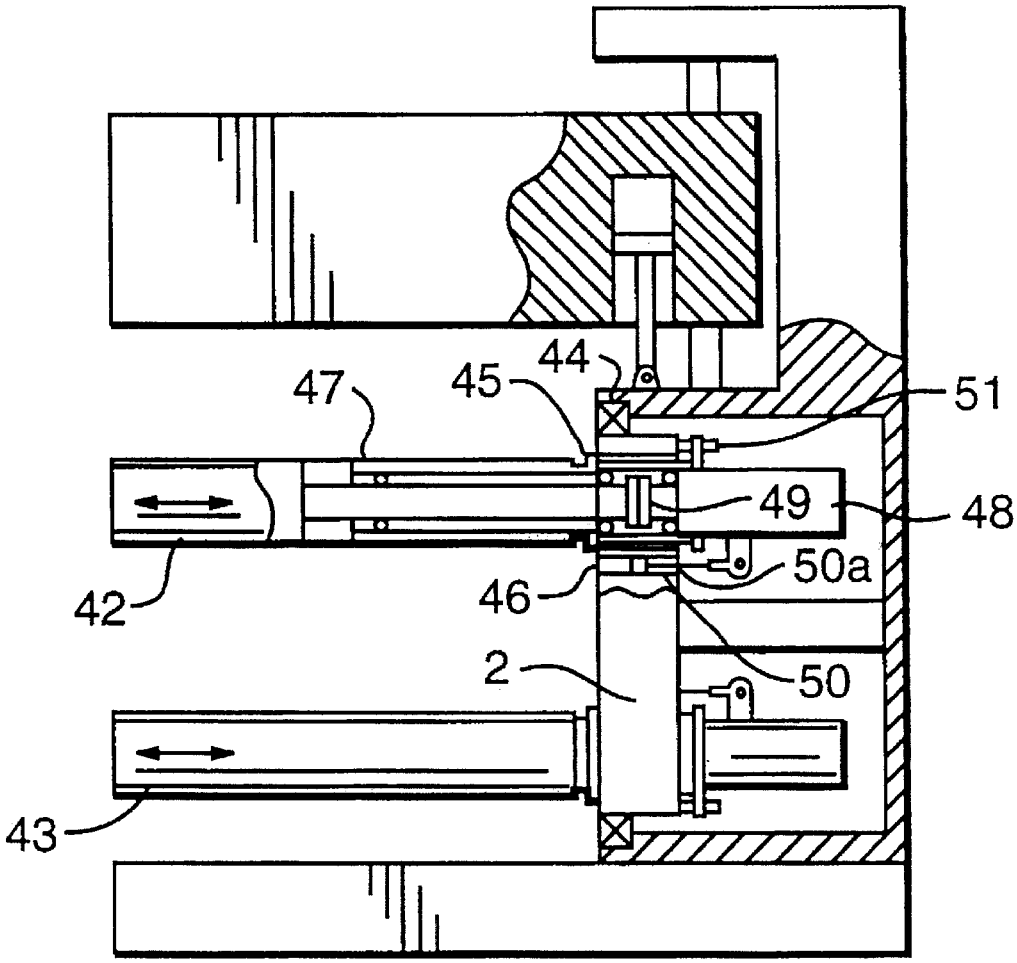
FIG. 28 is a cross section taken along a line 28—28 of FIG. 27.

Next, the structure of a second embodiment of the turret type yarn winder according to the present invention will be described with reference to FIGS. 27 and 28.

The winder of the second embodiment includes a turret member 2 pivoted on a machine frame 1, spindles 42 and 43 mounted on the turret member 1, for fixedly carrying bobbins thereon, a traverse mechanism 6 carried on a frame 5 movable up and down in the vertical direction above the spindles 42, 43, a contact roller 7 rotatably mounted on the frame 5, an upper yarn-switching mechanism 8 provided on the frame 5 above the traverse mechanism 6, a threading mechanism 10 mounted on the machine frame i for restricting a yarn path so that a yarn is wound on an empty bobbin at the initial stage of the yarn winding operation, and an initial-winding forming mechanism 11 mounted on the frame 5 so that it can project into a concave space A formed by the contact roller 7 and the empty bobbin 70 located at the yarn winding position.

The above winder is exactly the same as that shown in FIGS. 1, 3, 4 and 5, and therefore the explanation thereof is omitted, except for the structure for mounting the spindles 42, 43 to the turret member 2.

The spindle 42 or 43 includes a support tube 45 mounted on the turret member 2 by a slide bearing 44 to be movable in the lengthwise direction thereof, a shaft 47 rotatably mounted on the support tube 45 by a bearing 46 in a cantilever manner, a motor 48 coaxially mounted on the support tube 45, a coupling 49 for connecting the shaft 47 to an output shaft of the motor 48, a power cylinder 50 mounted on the turret member 2 in parallel to the support tube 45 and having a piston rod 50*a* coupled to the motor 48, and an anti-rotation pin 51 projected from the turret member 2 and inserted into the support tube 45.

The shaft 47 has a hole along its axis for supplying pressurized air, and a piston 15 and a spring are provided in the end portion as shown in FIG. 3. According to this structure, tubular bodies 18, 19 fitted on the outer periphery of the shaft 47 move to compress fixing rings 17 from both sides and expand the same in the radial direction. Thus the fixing rings 17 pressingly engage with the inner periphery of the bobbin and fix the same.

The power cylinder 50 is connected with a pressurized air supply pipe (not shown) having a solenoid valve which is actuated by a signal from a controller to switch a pressurized air path so that the piston rod 50*a* of the power cylinder 50 extends or retreats.

If the piston rod 50*a* extends by the supply of pressurized air to the power cylinder 50, the shaft 47 moves together with the support tube 45 relative to the turret member 2 to move the spindle 42 in the direction (c) toward the support end, while if the piston rod 50*a* retreats, the spindle 42 moves in the direction (b) toward the free end.

Figure 29:
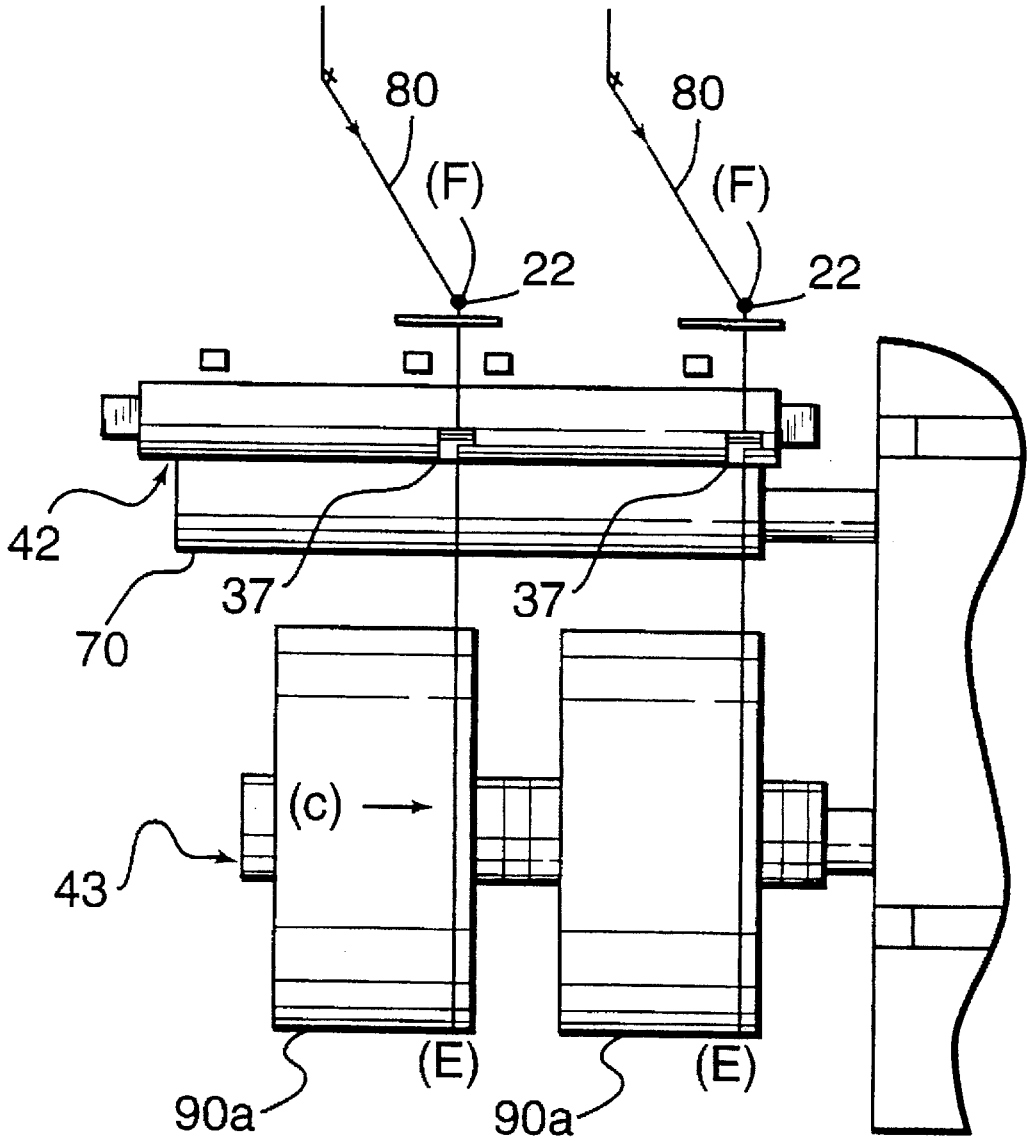
FIGS. 29 through 31 are fragmentary front elevation views illustrating yarn-switching operation of the second yarn winder according to the present invention.
Figure 30:
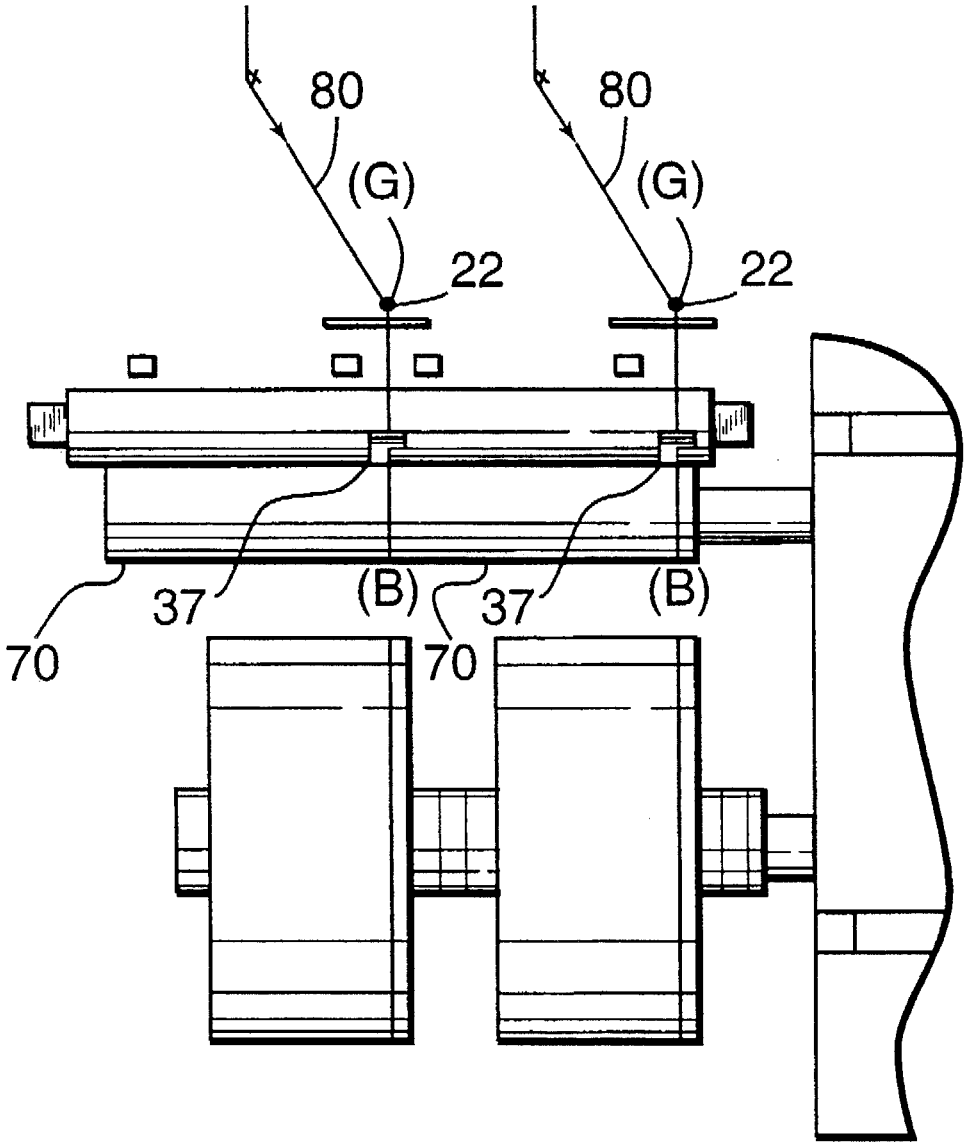

The yarn-switching operation in the above second winder will be described with reference to FIGS. 29 through 31.

When a predetermined amount of yarn 80 is wound on a bobbin to form a full bobbin, the turret member 2 rotates to move a full bobbin 70' located at the winding position to a doffing position and an empty bobbin 70 located at the doffing position to the winding position.

Then the yarn-removing guide 20 of the upper yarn-switching mechanism 8 moves in the direction perpendicular to the yarn running direction to push out the yarn 80 from the traverse guide 6*a* of the traverse mechanism 6, whereby the yarn 80 moves laterally toward the fulcrum of traverse motion.

Next, the yarn-pushing guide 22 moves from the waiting position in the direction (c) and catches the yarn 80 in the midway of this movement. When the pushing guide stops at a position F on the common vertical line so that the yarn 80 runs toward the yarn-catching part B, the power cylinder 50 of the spindle 43 carrying the full bobbin 70' is actuated to extend the piston rod 50*a* whereby the spindle 43 moves in the direction (c) toward the support end as shown in FIG. 29.

The yarn 80 runs while guided by the yarn-pushing guide 22 and is wound on the bunch-winding position E on the yarn layer section 90*a* of the full bobbin 70'.

Then the yarn-winding guide 37 of the initial-winding forming mechanism 11 projects into the concave space A formed by the contact roller 7 and the empty bobbin 70 located at the winding position. When engaging with the yarn 80 running to the bunch-winding position E on the yarn layer section 90*a* of the full bobbin 70', the yarn-pushing guide 22 moves to a position G on the common vertical line passing over the bunch-winding forming position C.

When the yarn-winding guide 37 projects to a predetermined position, the yarn 80 cuts into the yarn-catching part B and is caught thereby.

At that time, the power cylinder 50 of the spindle 42 is actuated to retreat the piston rod 50*a* whereby the empty bobbin 70 moves together with the spindle 42 in the direction (c) to the free end of the spindle 42 to carry out the yarn-searching operation. Thus the yarn 80 can assuredly cut into the yarn-catching part B.

When the above yarn-searching operation is carried out, the yarn-catching part B must be first located nearer to the support end of the spindle 42 than the position F of the yarn-catching guide 22, and at the completion of the yarn-searching operation, nearer to the free end of the spindle 42 than the position F of the yarn-catching guide 22.

Figure 31:
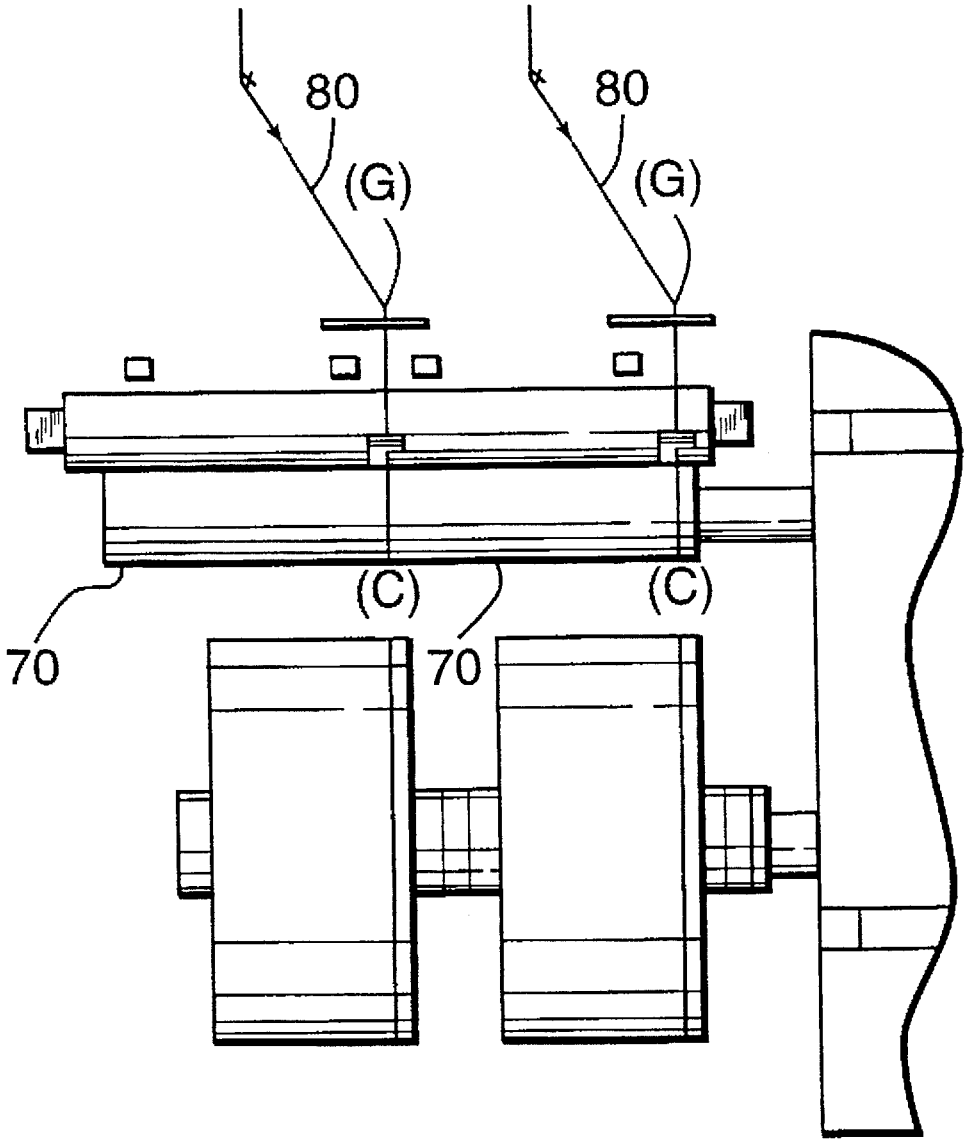

When the yarn 80 is caught by the yarn-catching part B, as shown in FIG. 31, the yarn is released from the yarn-winding guide 37 and wound on the bobbin 70 at the bunch-winding position C.

In this case, if the above yarn-searching operation is carried out while moving the spindle 42, the position F of the yarn 80 is restricted by the yarn-pushing guide 22 so that the yarn runs along the vertical line, since the lateral movement speed of the yarn 80 is faster than that of the spindle 42, whereby the yarn 80 slightly moves toward the yarn-catching part B while being wound on the bobbin 70, resulting in the wrapping wind for preventing the initially wound layer of yarn 80 from loosening.

Figure 32:
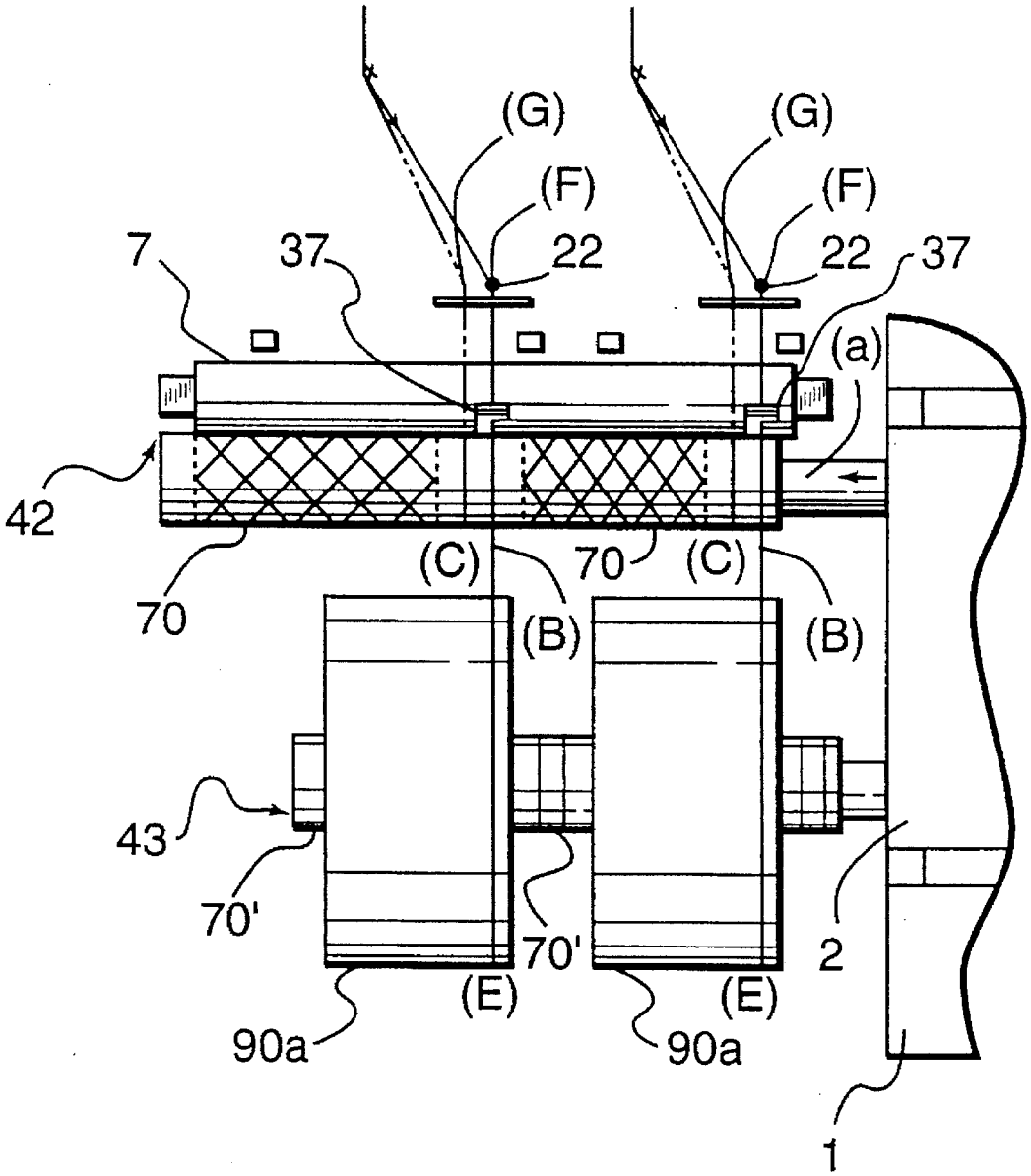
FIG. 32 illustrates a first yarn-switching operation of the second yarn winder according to the present invention.

Another yarn-switching operation conducted on the winder of the second embodiment will be described with reference to FIG. 32.

The yarn-switching from the full bobbin 70' to the empty bobbin 70 can be conducted in the second winder by moving the spindle 42 carrying the empty bobbin 70 in the direction (b) toward the free end thereof instead of moving the full bobbin 70', followed by the same steps as above.

In the above embodiment, the yarn-switching operation is conducted while forming the yarn-catching part B on the support end side of the spindle 3, 4. However, the yarn-switching may be conducted while forming the yarn-catching part B on the free end side of the spindle 3, 4 if the structure shown in FIGS. 9 and 10 is adopted.

Figure 9:
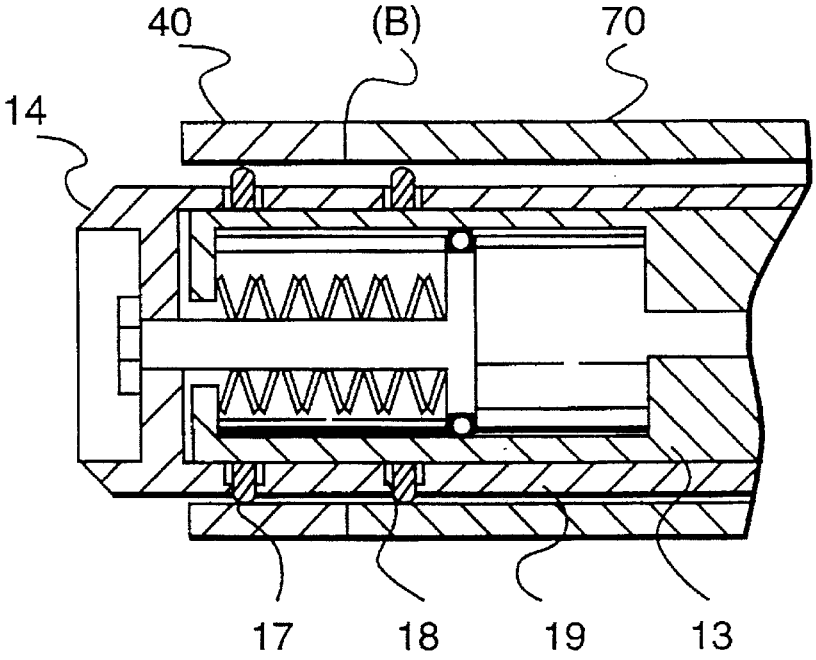
FIG. 9 is a schematic view of a third embodiment of a spindle in the yarn winder according to the present invention.

In the case of FIG. 9, a detachable ring 40 is fixedly fitted to a free end of the empty bobbin 70 so that the yarn-catching part B is formed by a boundary part between the end wall of the ring 40 and that of the empty bobbin 70.

Figure 10:
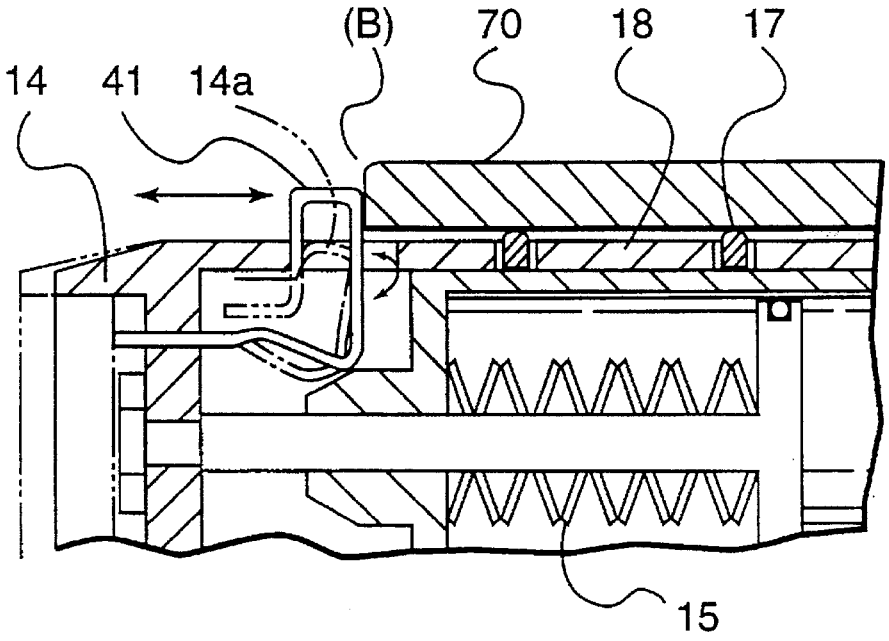
FIG. 10 is a schematic view of a fourth embodiment of a spindle in the yarn winder according to the present invention.

While, in the case of FIG. 10, a resiliently deformable stop 41 is mounted to a piston 14 disposed at the free end of the spindle 3, 4 and, when the piston 14 moves to the support end side of the shaft 12 by the spring 15, the stop 41 projects from holes 14*a* formed on the outer periphery of the piston 14 and comes into contact with the end wall of the empty bobbin 70 to provide the yarn-catching part B.

Figure 11:
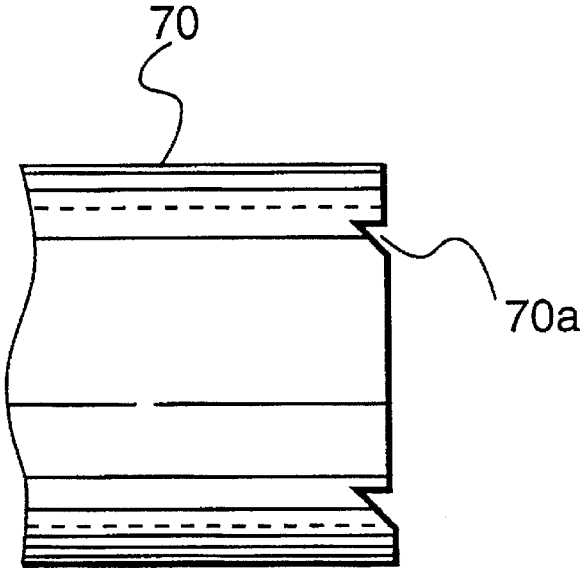
FIG. 11 is a schematic view of a first embodiment of a bobbin used in the yarn winder according to the present invention.
Figure 12:
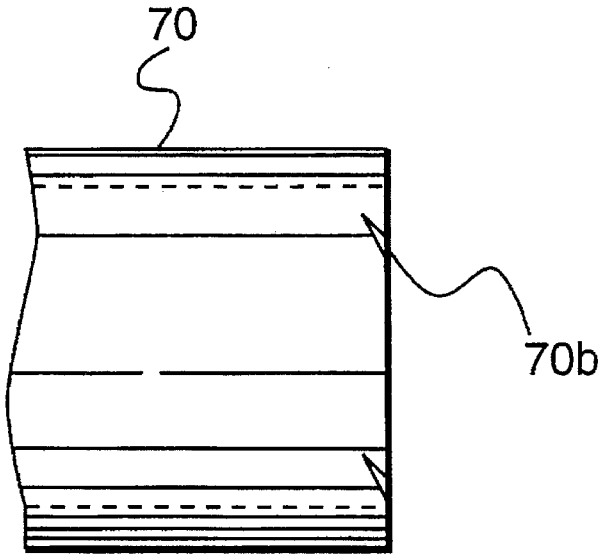
FIG. 12 is a schematic view of a second embodiment of a bobbin used in the yarn winder according to the present invention.

If notches 70*a* as shown in FIG. 11 or cuts 70*b* as shown in FIG. 12 are formed on an end wall of the empty bobbin 70 on the side where the yarn moves to the bunch-winding forming part, it is possible to more assuredly catch the yarn and smoothly slide the yarn upward from the yarn-catching part B to the outer periphery of empty bobbin 70 since the yarn is brought into contact with the notch 70*a* or the like formed on the end wall of the empty bobbin 70.

Next, another embodiment of yarn-winding bobbin 70 according to the present invention will be described below.

Figure 33:
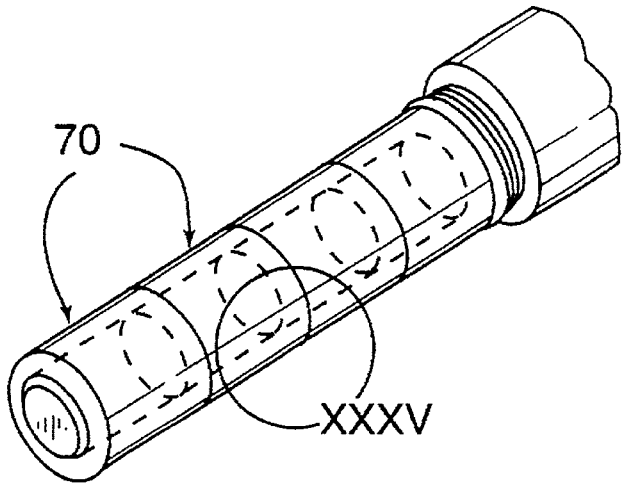
FIG. 33 is a schematic perspective view of a bobbin according to the present invention mounted on a spindle.
Figure 34:
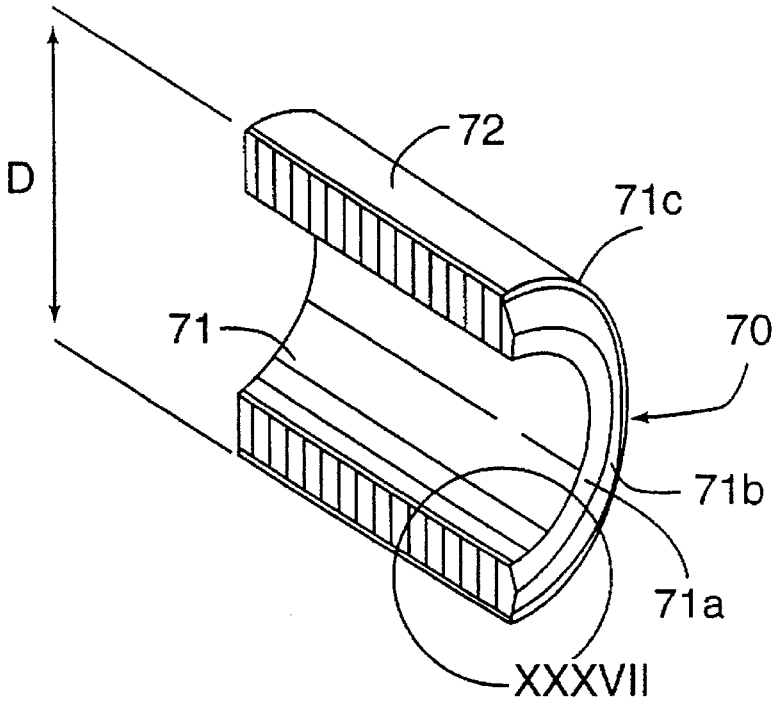
FIG. 34 is a schematic perspective view illustrating a shape of a second embodiment of a bobbin.
Figure 35:
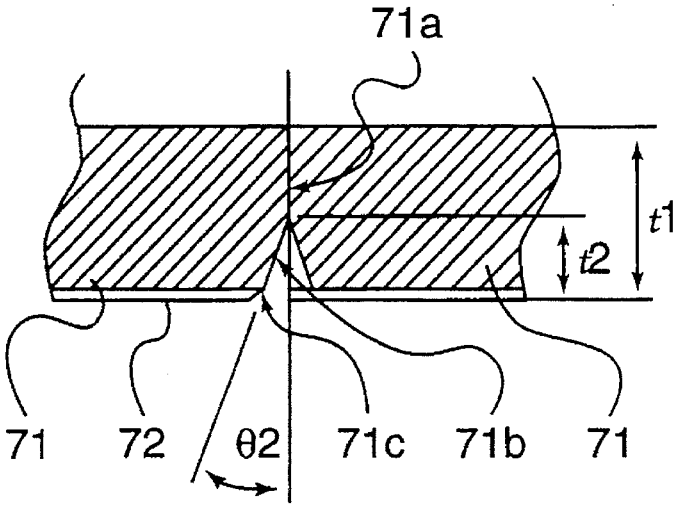
FIG. 35 is an enlarged view of area XXXV Of FIG. 33.
Figure 36:
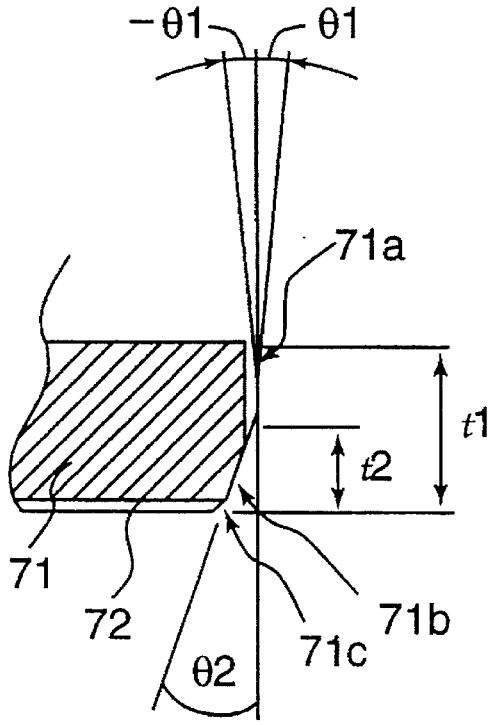
FIG. 36 is an enlarged view of a shape of bobbin end other than FIG. 35.

FIG. 33 is a schematic perspective view illustrating a spindle carrying yarn-winding bobbins thereon; FIG. 34 is a diagrammatic sectional view of a second embodiment of a yarn-winding bobbin of FIG. 33; FIG. 35 is an enlarged view of area VI of FIG. 33; and FIG. 36 is an enlarged view of an end portion of further embodiment of bobbin. The bobbin 70 is manufactured by laminated paper while the outer periphery thereof is covered with a surface paper 72. A surface 71*a* generally parallel to a plane perpendicular to the lengthwise direction of a cylindrical body 71 is formed. One or both of end surfaces of the cylindrical body has a plane vertical to the lengthwise direction in a radially inner area thereof and a surface 71*b* slanted from the edge of the surface 71*a* to the outer periphery of the bobbin in the lengthwise direction. The slanted surface 71*b* is connected with the outer periphery of the cylindrical body via a rounded edge 71*c*.

To obtain a suitable dimensions of bobbin 70, bobbin samples were prepared while varying a thickness t2 of the slanted surface 71*b* and an angle θ2 between the slanted surface 71*b* and a line vertical to the lengthwise direction based on a standard cylindrical body prepared by a laminated paper, having an outer diameter D of 126 mm, an inner diameter d of 110 mm, and a wall thickness t1 of 8 mm. The yarn-switching tests were conducted while taking up a polyester yarn of 75 denier on these samples in the turret type winder shown in FIGS. 1 and 2 at a running speed of 4500 m/min. The results were listed in Tables 1 and 2.

The same results were obtained when a turret type winder of another type is used instead of the above one, in which bobbins are pushed from a free end to a base end of a spindle so that the respective bobbins are retained on the spindle by a pressing force.

TABLE 1

Outer diameter D of bobbin: 126 mm
Inner diameter d of bobbin: 110 mm
Radius of rounded edge: 1 mm

| θ2 | t1 (mm) | t2 (mm) | t2/D × 100 (%) | Success (%) | Cause of failure |
|---|---|---|---|---|---|
| 3 | 8 | 2 | 1.6 | 100 | |
| 3 | 8 | 4 | 3.2 | 100 | |
| 3 | 8 | 5 | 4 | 90 | Tension reduction |
| 3 | 8 | 8 | 6.3 | 10 | Tension reduction |
| 5 | 8 | 3 | 2.3 | 100 | |
| 8 | 8 | 3 | 2.3 | 95 | Inferior yarn grip |
| 1 | 8 | 3 | 2.3 | 90 | Inferior yarn grip |
| 0 | 8 | 3 | 2.3 | 85 | Inferior yarn grip |

TABLE 2

Outer diameter D of bobbin: 126 mm
Inner diameter d of bobbin: 110 mm

| Edge 2c (mm) | θ2 | t2 (mm) | t2/D × 100 (%) | Success (%) | Yarn end length (cm) |
|---|---|---|---|---|---|
| 1 | 3 | 3 | 2.3 | 100 | 70 |
| 2 | 3 | 3 | 2.3 | 100 | 115 |
| 3 | 3 | 4 | 3.2 | 95 | 300 |

It is ideal to form the plane 71*a* on the bobbin 70 so that an angle (θ1) made between the plane 71*a* and a vertical line perpendicular to the longitudinal axis as shown in FIG. 36 becomes 0°. However, since there is a manufacturing tolerance and the bobbin may be deformed due to the lengthwise compression when the bobbin is fastened on the spindle, the angle (θ1) is preferably in a range within ±2°.

When the outer diameter of bobbin is 126 mm as shown in Table 1, the distance t2 of the slanted surface 71*b* from the outer periphery of the bobbin to the surface 71*a* is preferably not more than 4% of the outer diameter of bobbin, because, if t2 is less than 3 mm, the peripheral speed difference becomes larger to extremely lower the yarn tension, which then worsens the success rate of the yarn-switching operation to a great extent.

Also, as shown in FIG. 35, it is ideal to form the slanted surface 71*b* so that an angle θ2 relative to a vertical line perpendicular to a longitudinal axis becomes, smaller. However, if the angle θ2 is not more than 1° as shown in Table 1, the success rate of yarn-switching operation is lowered to less than 90% due to inferior yarn-introduction, while, if the angle θ2 reaches 8°, the success rate is also lowered to less than 95% due to insufficient yarn-catching.

Accordingly, the angle θ2 is preferably in a range between 2° and 5° so that the yarn can be assuredly introduced into the yarn-catching part, and thereafter, brought into contact with the slanted surface 2*b* and moved quickly on the outer periphery.

If the edge 71*c* connecting the slanted surface 71*b* with the outer periphery of cylindrical body has a radius of curvature of 3 mm as shown in Table 2, a yarn-end length wound on other than bunch-winding part amounts to 300 cm because the movement from the yarn-catching part to the outer periphery is delayed. Also the success rate of the yarn-switching operation is lowered to 95% due to the failure of yarn-catching operation.

Accordingly, the edge 71*c* is preferably formed to have a radius of curvature of less than 2 mm.

The radius of curvature is preferably more than 0.3 mm to prevent damage of the yarn or the generation of fluff which may occur when the yarn is brought into contact with the edge 71*c*.

Figure 43:
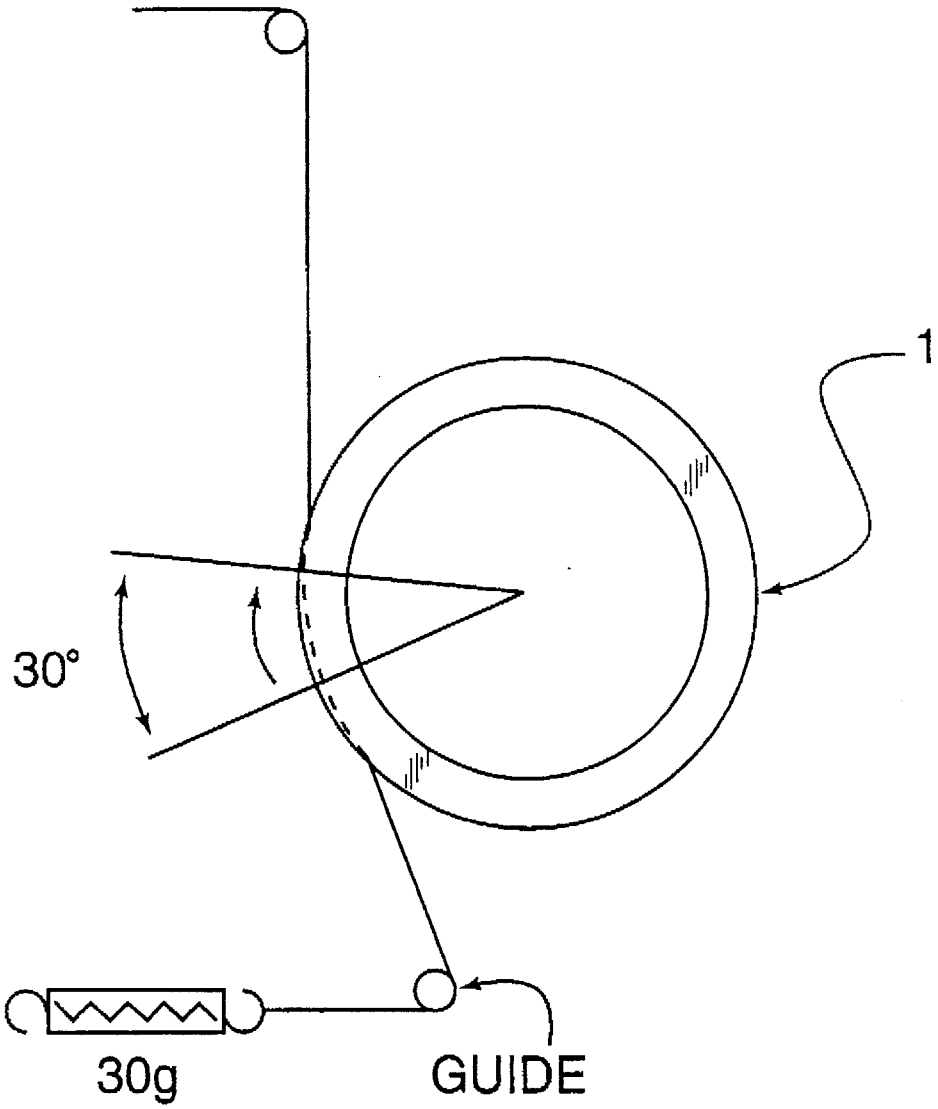
FIG. 43 is a schematic illustration of a device for testing a stability of yarn caught on a bobbin.
Figure 44:
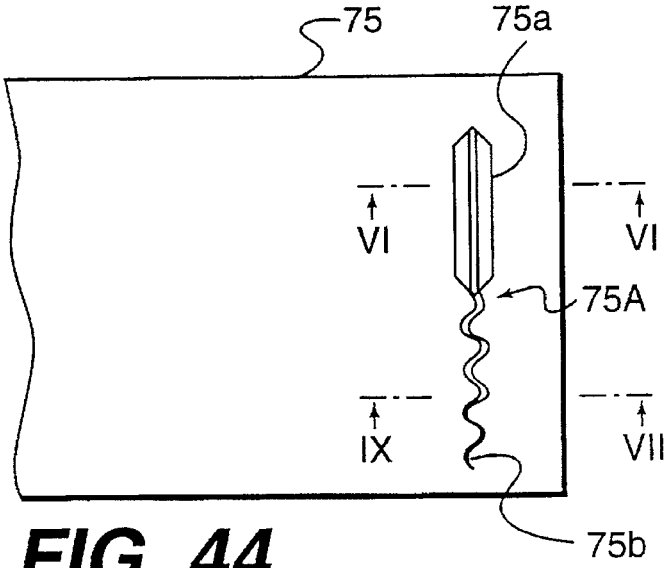
FIG. 44 (PRIOR ART)
FIG. 44 is a schematic illustration of one embodiment of a bobbin used for the conventional yarn winder.
Figure 45:
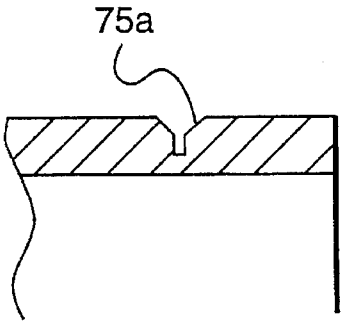
FIG. 45 (PRIOR ART)
FIG. 45 is a cross section taken along a line 45—45 of FIG. 44.
Figure 46:
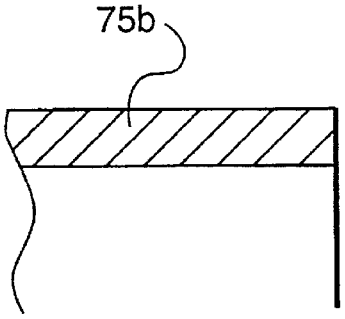
FIG. 46 (PRIOR ART)
FIG. 46 is a cross section taken along a line 46—46 of FIG. 44.
Figure 47:
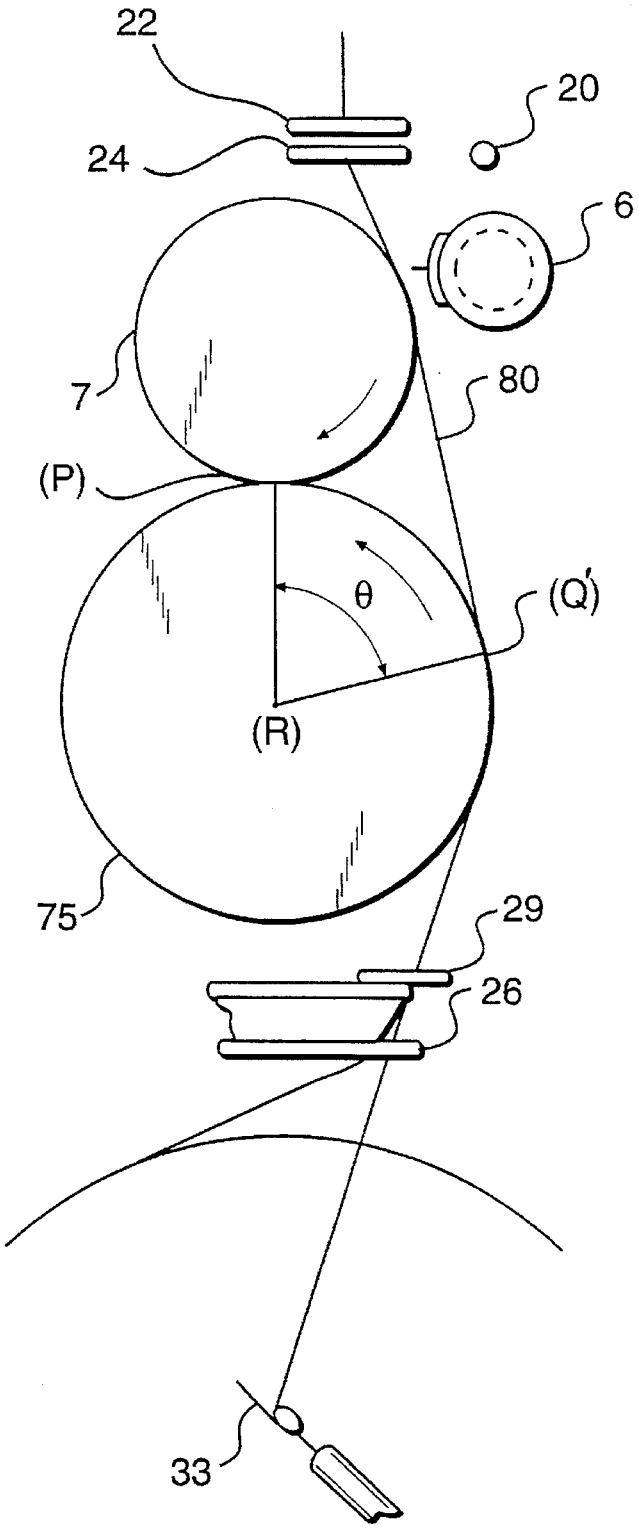
FIG. 47 PRIOR ART
FIG. 47 is a schematic illustration of a yarn path in the initial-yarn winding operation in the conventional winder.

Since the yarn-catching force of the bobbin 70 largely relies on a surface roughness, a test was conducted to determined the favorable surface roughness of the slanted surface 71*b* as follows. Slanted surfaces 71*b* having the surface roughness of JIS $R_{max}$ 12S and JIS $R_{max}$ were prepared. As shown in FIG. 43, a 75*d* polyester filament yarn was engaged with the respective slanted surface at a wrapping angle of 30° while tensioned at 30*g* by means of a portable balance 20. As a result, the yarn slips when the surface roughness is JIS $R_{max}$ 8S but is broken when the surface roughness is JIS $R_{max}$ 12S.

Thus, the surface roughness of the slanted surface 71*b* is preferably more than JIS $R_{max}$ 12S for the purpose of assuredly catching the yarn.

Figure 37:
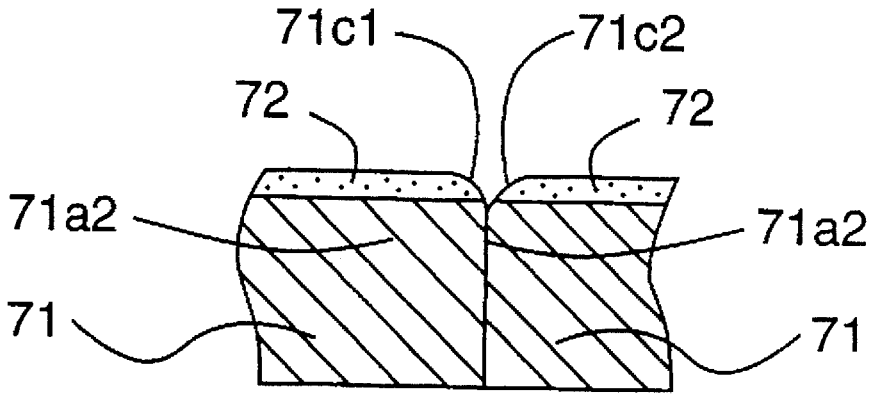
FIG. 37 is a schematic enlarged view of area XXXVII of FIG. 34, illustrating a shape of a second embodiment of a bobbin according to the present invention.

FIG. 37 is an enlarged view of area XXXXVII FIG. 33, for illustrating a shape of a second embodiment of bobbin according to the present invention. In this bobbin 70, a cylindrical body 71 is formed by laminated paper and a surface paper 72. The opposite end surfaces of the cylindrical body 71 are formed by planes 71*a*1 and 71*a*2 generally parallel to a plane perpendicular to the longitudinal axis, and edges 71*c*1 and 71*c*2 connected the respective planes 71*a*1, 72*a*2 with the outer periphery of the cylindrical body are formed to be arcuate.

Regarding this bobbin, various combinations of dimensions in the respective edges 71*c*1, 71*c*2 were prepared similar to the first embodiment. A yarn-switching test was conducted on these bobbins while winding a 75*d* polyester yarn thereon by a turret type winder at a yarn speed of 4500 m/min. Results were obtained as listed in Table 3.

TABLE 3

Outer diameter D of bobbin: 126 mm
Inner diameter d of bobbin: 110 mm

| Edge 2c1 (mm) | Edge 2c2 (mm) | Success rate (%) | Yarn-end Lgth (cm) | Cause of failure |
|---|---|---|---|---|
| 1 | 2 | 100 | 70 | |
| 1 | 3 | 100 | 73 | |
| 2 | 2 | 100 | 110 | |
| 2 | 3 | 100 | 115 | |
| 2 | 4 | 95 | 152 | Tension reduction |
| 3 | 3 | 90 | 500 | Tension reduction |
| 3 | 4 | 10 | 750 | Tension reduction |
| 3 | 5 | 0 | — | Tension reduction |

In the above combinations, if the edge 71*c*1 is 3 mm and the edge 71*c*2 is larger than 3 mm, the movement of yarn from the yarn-catching part to the outer periphery is delayed, whereby a yarn-end length of longer than 500 cm is wound on other than bunch-winding part. Also the bottom diameter of the yarn-grip part becomes too small, whereby the yarn tension is reduced to lower the success rate of yarn-switching operation to a value less than 90%.

Accordingly, a radius of curvature of the edge 71*c*1 is preferably less than 2 mm, and that of the edge 71*c*2 in a range between 2 and 4 mm.

Figure 38:
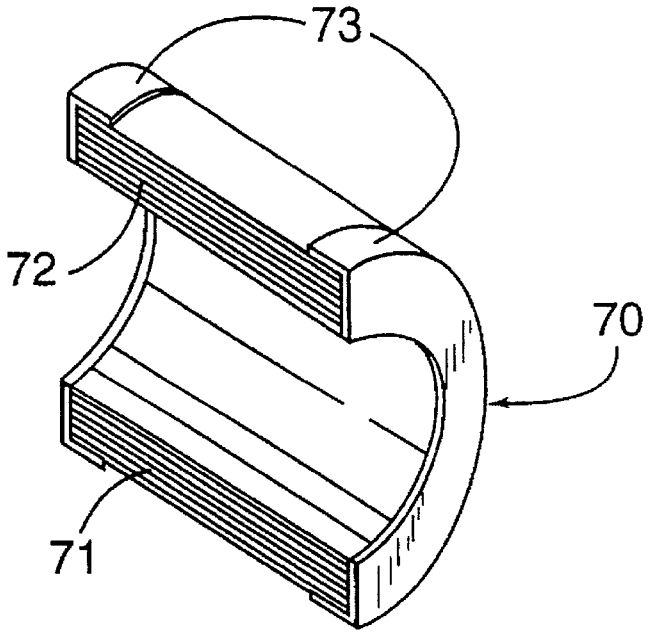
FIG. 38 is a schematic cross section illustrating a shape of a third embodiment of a bobbin according to the present invention.
Figure 39:
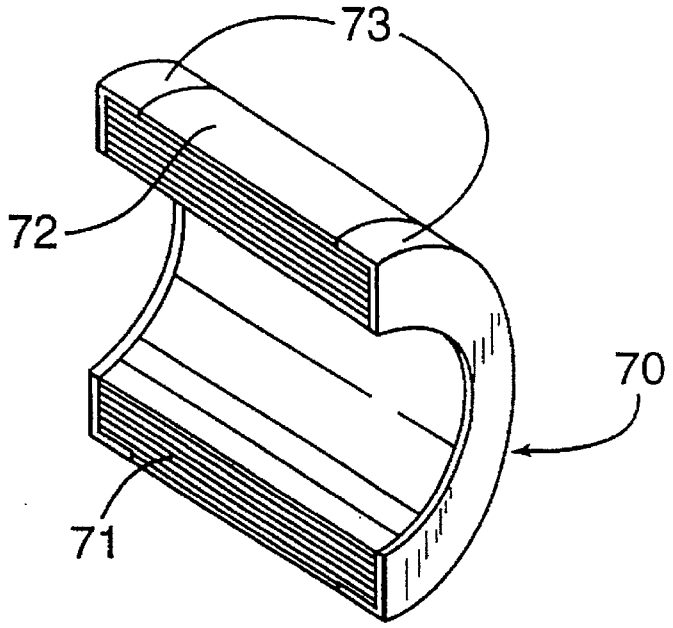
FIG. 39 is a schematic cross section illustrating a shape of a fourth embodiment of a bobbin according to the present invention.

FIG. 38 is a schematic sectional view of a third embodiment of a bobbin according to the present invention and FIG. 39 is that of a fourth embodiment, wherein a bobbin 70 consists of a cylindrical body 71 formed by laminated paper and a surface paper 72 adhered to the outer periphery of the cylindrical body 71, and a protective member 73 covering at least one end surface and part of outer periphery in the vicinity thereof.

While the protective member 74 is preferably formed by adhering a thin paper having a thickness of less than 0.1 mm, it is also possible to press-fit a cup-shaped member into the cylindrical body 71, which member is produced by an injection-molding of polymer material such as ABS resin or vinyl chloride resin and has a thickness in a range between 0.5 mm and 2 mm, preferably 1 mm.

As shown in FIG. 38, the above protective member 73 is attached by means, for example, of adhesive so that a step is formed between the outer peripheries of bobbin 70 and protective member 73 or no step is formed on the outer periphery of bobbin 70.

When the yarn is wound on the bobbin 70, the caught yarn is brought into contact with the slanted surface 71*b* or vertical surface 71*a* and immediately lifted up by a frictional force onto the outer periphery to form a bunch-winding 90*b* thereon, whereby it is possible not only to reduce a length of yarn end 90*a* extending out of the bunch-winding part to abut 115 cm or less, but also to form the bunch-winding 90*b* at a position apart by 5 mm to 10 mm from the bobbin end.

While the length of yarn end 90*a* is one measured when the yarn is extended in a straight state, the actual yarn end 90*a* is in a range between 20 cm and 30 cm because it is in a crimped state when broken.

Also the yarn end 90*a* is fixed by the bunch-winding 90*b* not to be unwound even though it is drawn.

Figure 40:
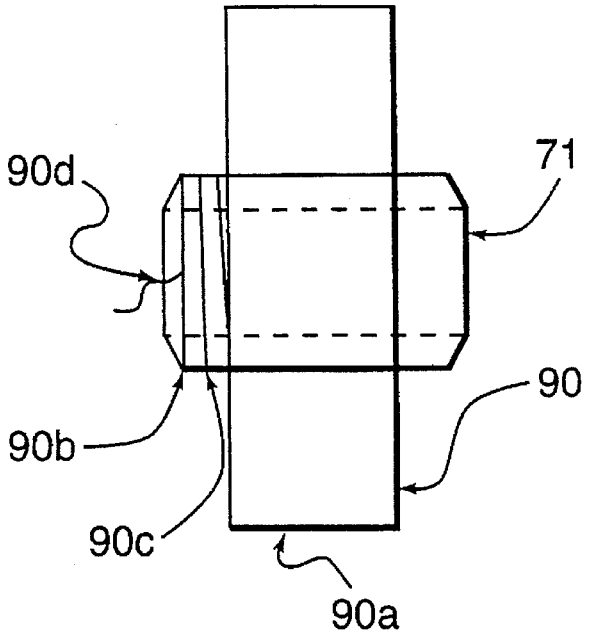
FIG. 40 is a schematic illustration of a shape of a first embodiment of a yarn package according to the present invention.

As a result, as shown in FIG. 40, a package 90 provided with a bunch-winding 90*b* for securing a yarn end 90*a*, a tail-winding 90*c* and a yarn layer portion 90*d*, which are sequentially formed on the outer periphery of bobbin 70 from one end thereof.

Figure 41:
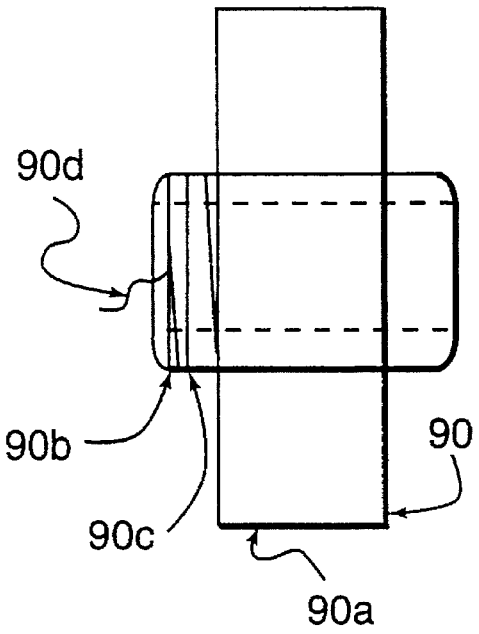
FIG. 41 is a schematic illustration of a shape of a second embodiment of a yarn package according to the present invention.
Figure 42:
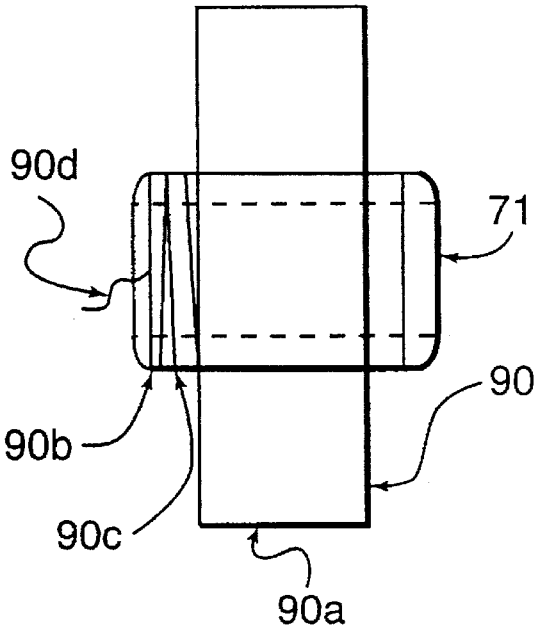
FIG. 42 is a schematic illustration of a shape of a third embodiment of a yarn package according to the present invention.

If a yarn is wound on a bobbin shown in FIG. 37, a package 90 shown in FIG. 41 is obtainable, while, if wound on a bobbin shown in FIG. 38, a package 90 shown in FIG. 42 is obtainable.

EFFECT OF THE INVENTION

Since the inventive method for winding a yarn comprises the steps of engaging a running yarn with a yarn-catching part formed by a boundary part between ends of the adjacent bobbins fixedly carried on a spindle or a boundary part between one end of a bobbin and a side wall of a stepped portion of the spindle for positioning the bobbin, moving the yarn from the yarn-catching part to a bunch-winding position of the respective bobbin immediately after the yarn is caught by the yarn-catching part, forming a bunch-winding at the bunch-winding position, forming a predetermined tail-winding, and initiating the normal yarn winding operation while reciprocating the yarn by a traverse guide, it is possible to use a tube made of synthetic resin or aluminum alloy having no yarn-catching groove as a bobbin for winding a yarn. This enables the bobbin to be reused. Also it is possible to obtain a package in which a yarn length in the yarn-catching part between the yarn-catching position and the bunch-winding beginning position can be reduced, whereby the entanglement of yarn extending from the bunch-winding and hanging down during the doffing operation with another full bobbin can be obtained.

Since the bobbin 70 has no yarn-catching groove, it is possible to easily carry out the removal of bunch-winding in a shorter time.

Since a winder according to the present invention comprises an upper yarn path restricting guide upstream of a contact roller, for guiding a running yarn to a bunch-winding position, and a yarn-winding guide for engaging the yarn running while being guided by the upper yarn path restricting guide with a yarn-catching part of an empty bobbin fixedly carried on a spindle, positioned in a concave space formed between the contact roller and the empty bobbin fixedly carried on the spindle, it is possible to assuredly wind the yarn in the yarn-catching part, after which the yarn thus caught by the yarn-catching part immediately moves to a bunch-winding position and is wound thereon. Thereby the bunch-winding is assuredly formed at a predetermined position and a yarn length from the yarn-engaging position in the yarn-catching part to the bunch-winding beginning position can be reduced.

Also, since it is possible to reduce a rotational angle (θ) of the spindle between the catching of yarn by the yarn-catching part and the beginning of winding, the tension reduction can be minimized accordingly, whereby the success rate of the yarn-switching operation is improved.

Figure 48:
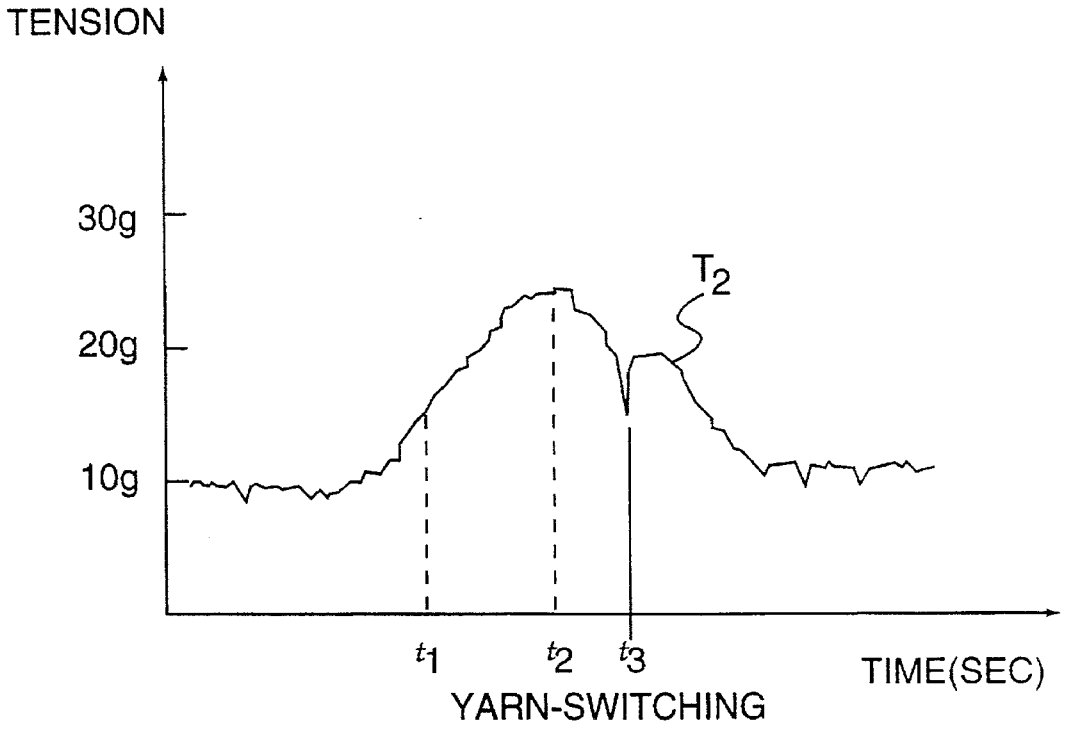
FIG. 48 is a graph illustrating the variation of yarn tension during the yarn-switching operation according to the present invention.
Figure 49:
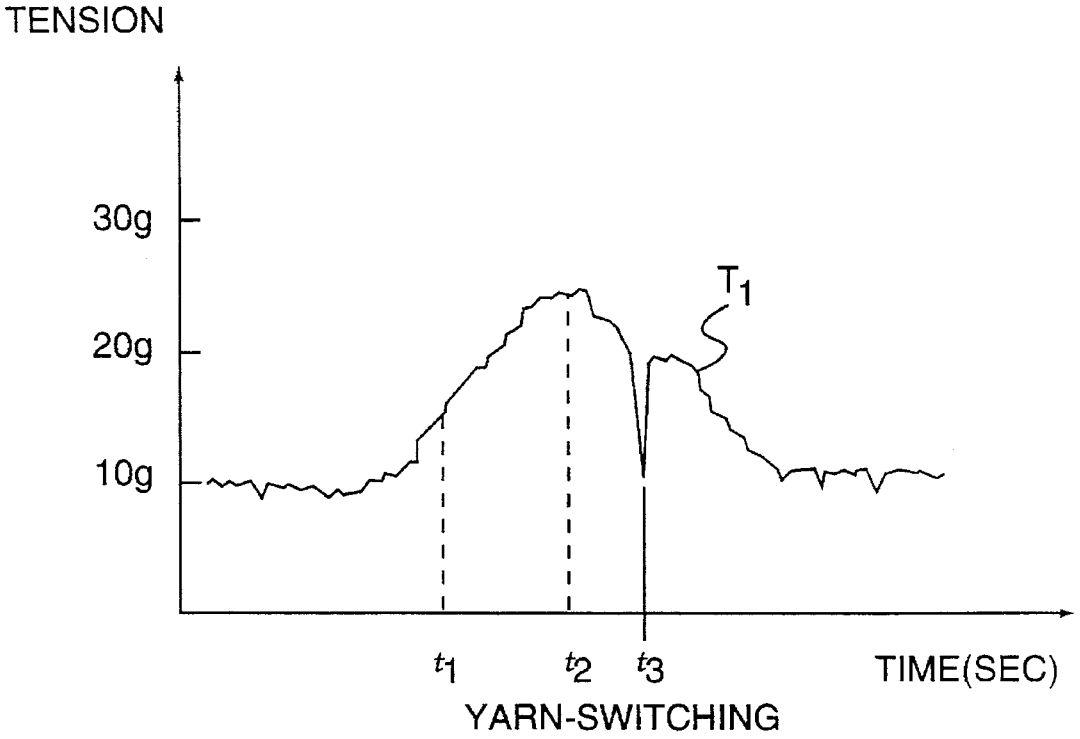
FIG. 49 (PRIOR ART)
FIG. 49 is a graph illustrating the variation of yarn tension during the conventional yarn-switching operation.

That is, FIG. 48 illustrates a yarn tension variation according to the inventive yarn-switching method obtained from a yarn tension measurement similar to FIG. 49. As apparent from a graph T in FIG. 48, in the yarn tension in the inventive yarn-switching method, a degree of reduction of yarn tension at a yarn-switching instant t3 is significantly less than that resulting from the conventional method shown in FIG. 49. Thereby, according to the inventive yarn-switching method, no yarn is wound due to slack around a take-up roller disposed upstream of the winding part, whereby the yarn-switching operation can be assuredly conducted.

If the inventive winder comprises an upper yarn path restricting guide upstream of a contact roller, for guiding a running yarn to a bunch-winding position, and a yarn-winding guide for engaging the yarn running while being guided by the upper yarn path restricting guide with a yarn-catching part of an empty bobbin fixedly carried on a spindle, positioned in a concave space formed between the contact roller and the empty bobbin; the yarn-catching part being formed by a boundary part between ends of the adjacent bobbins fixedly carried on a spindle or a boundary part between one end of a bobbin and a side wall of a stepped portion of the spindle for positioning the bobbin, the yarn can be more reliably caught by the yarn-catching part and immediately moved to the bunch-winding position, whereby reliable bunch-winding is formed at a predetermined position and a yarn length from the yarn-engaging position in the yarn-catching part to the bunch-winding beginning position can be reduced.

Since a yarn-winding bobbin according to the present invention may have at least one end surface of a cylindrical hollow body, formed by an inner side wall generally perpendicular to a lengthwise axis of the cylindrical body and an outer slanted wall extending outward from the outer edge of the cylindrical body to the side wall and connected with the outer periphery of the cylindrical body via a circular cross-sectional wall having a radius of curvature of not more than 2 mm, the yarn is assuredly guided to the yarn catching part by the introduction part formed with a slanted surface and caught thereby. Thereafter, the yarn is immediately moved to the outer periphery while engaging with the slanted surface, and reliably forms the bunch-winding.

As a result, it is possible to reduce the yarn end length extending from the bunch-winding and form the bunch-winding in the vicinity of bobbin end, whereby a bobbin length can be shortened.

Similar effects are obtainable if the bobbin has a structure wherein each of the opposite ends of a cylindrical body is formed by a side wall generally perpendicular to a lengthwise axis of the cylindrical body and wherein one of the side walls is connected with the outer edge of the cylindrical body via a circular cross-sectional wall having a radius of curvature of not more than 2 mm and the other of the side walls is connected with the outer edge of the cylindrical body via a circular cross-sectional wall having a radius of curvature larger than that of the former circular cross-sectional wall. Also, if the bobbin is formed of a cylindrical body of laminated paper wherein a side wall of the respective end or one end of the cylindrical body and the outer periphery of the cylindrical body in the vicinity thereof are covered with a protective member, the deformation can be avoided even if it is repeatedly used. For example, the life of the inventive bobbin in the repeated use is prolonged about three times relative to the conventional bobbin.

On the other hand, a yarn package according to the present invention is formed on a bobbin having at least one end surface of a cylindrical hollow body, formed by an inner side wall generally perpendicular to a lengthwise axis of the cylindrical body and an outer slanted wall extending outward from the side wall and connected with the outer periphery of the cylindrical body via a circular cross-sectional wall having a radius of curvature of not more than 2 mm, while sequentially forming from said end of the cylindrical body a bunch-winding for anchoring a yarn end, a tail-winding and substantial yarn-layers. Thereby a yarn end becomes shorter and is anchored by the bunch-winding not to unwind, whereby the doffing operation and the transportation of package can be easily carried out. Also, since the V-shaped groove is not provided for catching a yarn as in the conventional bobbin, the removal of bunch-winding and tail-winding for the purpose of easing the post process can be easily carried out.

Similar effects are obtainable by the yarn package, formed on a bobbin having a structure wherein each of the opposite ends of a cylindrical body is formed by a side wall generally perpendicular to a lengthwise axis of the cylindrical body and wherein one of the side walls is connected with the outer edge of the cylindrical body via a circular cross-sectional wall having a radius of curvature of not more than 2 mm and the other of the side walls is connected with the outer edge of the cylindrical body via a circular cross-sectional wall having a radius of curvature larger than that of the former circular cross-sectional wall, while sequentially forming from the end of the cylindrical body a bunch-winding for anchoring a yarn end, a tail-winding and substantial yarn-layers.

In addition, the yarn package may be formed on a bobbin formed of a cylindrical body of laminated paper wherein a side wall of the respective end or one end of the cylindrical body and the outer periphery of the cylindrical body in the vicinity thereof are covered with a protective member, while sequentially forming from the end of the cylindrical body a bunch-winding for anchoring a yarn end, a tail-winding and substantial yarn-layers, so that the deformation is avoided even if a shock is applied to the bobbin during the doffing and transportation of the package.

We claim:

1. A method for winding yarn, comprising the steps of:

mounting at least two adjacent bobbins on a spindle to be fixedly carried on the spindle and in contact with a contact roller, and forming a yarn-catching part between adjacent ends of the at least two fixedly carried bobbins or between one end of one of the at least two adjacent bobbins and a stepped side wall portion of the spindle for positioning the bobbins;

providing a yarn winding guide facing a wedge shaped space formed between the contact roller and one of the bobbins, the wedge shaped space, in a cross section transverse to the axis of the spindle, converging toward a nip point between the contact roller and the bobbins;

relatively moving the yarn-winding guide and the nip point toward each other, causing a running yarn to be engaged by said yarn-catching part, thereby causing the yarn to be instantly freed from the yarn-winding guide and to be wound on an empty one of the bobbins after a fraction of one complete rotation of the empty bobbin and allowing the yarn to be instantly moved to a bunch-winding position of the respective at least two bobbins;

forming a bunch-winding at the bunch-winding position, and then forming a tail-winding; and initiating a normal yarn winding operation while reciprocating the yarn by a traverse guide.

2. A yarn winder comprising:

a spindle on which bobbins are fixedly carried, the spindle having an axis;

a contact roller positioned for contact with the bobbins on the spindle;

a yarn-catching part formed at an end of each of the bobbins to engage a running yarn;

an upper yarn path restricting guide located upstream from the contact roller for guiding the running yarn to a bunch winding position of a corresponding bobbin;

a yarn-winding guide arranged to face a wedge shaped space formed between the contact roller and one of the bobbins, the wedge shaped space, in a cross section transverse to the axis of the spindle, converging toward a nip point between the contact roller and the bobbins; and means for effecting relative movement of the yarn-winding guide and the nip point toward each other while the yarn is guided by the upper yarn path restricting guide, thereby causing the running yarn to be engaged by said yarn-catching part, to be instantly freed from the yarn guide and to be wound on the bobbin after a fraction of one complete rotation of the one bobbin, allowing the yarn to be instantly moved to a bunch-winding position of the respective bobbin.

3. A yarn winder comprising:

a spindle on which at least two adjacent bobbins are fixedly carried, the spindle having an axis;

a contact roller positioned for contact with the at least two bobbins on the spindle;

a yarn-catching part formed between ends of the adjacent fixedly carried bobbins or between one end of one of the at least two bobbins and a stepped side wall portion of the spindle for positioning the bobbins;

an upper yarn path restricting guide located upstream from the contact roller for guiding a running yarn to a bunch winding position of a corresponding bobbin;

a yarn-winding guide arranged to face a wedge shaped space formed between the contact roller and the bobbins, the wedge shaped space, in a cross section transverse to the axis of the spindle, converging toward a nip point between the contact roller and the bobbins; and means for effecting relative movement of the yarn-winding guide and the nip point toward each other while the yarn is guided by the upper yarn path restricting guide, thereby causing the running yarn to be engaged by said yarn-catching part, to be instantly freed from the yarn-winding guide and to be wound on the bobbin after a fraction of one complete rotation of the bobbin, allowing the yarn to be instantly moved to a bunch-winding position of the respective bobbin.

4. A yarn winder according to claim 3, wherein each of said bobbins is formed as a cylindrical hollow body formed at least at one end with a radial inner end surface extending substantially transverse to the axis of the spindle and a radial outer end surface extending from said inner end surface, the outer end surface being inclined, with respect to the inner end surface, toward an outer cylindrical surface of the cylindrical hollow body, and joining with a rounded edge between the inclined outer end surface and the outer cylindrical surface of the cylindrical hollow body, the rounded edge having a radius of curvature of not more than 2 mm, the rounded edge of one of the bobbins cooperating with a rounded edge of an adjacent bobbin to form said yarn-catching part therebetween.

5. A yarn winder according to claim 3, wherein each of said bobbins is formed as a cylindrical hollow body having first and second axially spaced end surfaces, each of said end surfaces being formed, at its outer periphery connecting with an outer cylindrical surface of the cylindrical hollow body, with a rounded edge of a radius of the curvature which is larger than a radius of the curvature of the edge at the second end surface.

* * * * *

UNITED STATES PATENT AND TRADEMARK OFFICE

CERTIFICATE OF CORRECTION

PATENT NO. : 5,653,395
DATED : August 5, 1997
INVENTOR(S) : IWADE et al.

It is certified that error appears in the above-indentified patent and that said Letters Patent is hereby corrected as shown below:

On the Title page, item [86] "PCT/JP94/00700" should read --PCT/JP94/00783--.

Signed and Sealed this

Fourteenth Day of October, 1997

*Attest:*

*Attesting Officer*

BRUCE LEHMAN

*Commissioner of Patents and Trademarks*